US008919238B2

(12) United States Patent
Steimke et al.

(10) Patent No.: US 8,919,238 B2
(45) **Date of Patent: *Dec. 30, 2014**

(54) WEAPON SYSTEM WITH SHORT RECOIL IMPULSE AVERAGING OPERATING GROUP

(75) Inventors: David Steimke, La Burlington, VT (US); Glenn Rossier, Ferrisburg, VT (US)

(73) Assignee: General Dynamics—OTS, Inc., St. Petersberg, FL (US)

( * ) Notice: Subject to any disclaimer, the term of this patent is extended or adjusted under 35 U.S.C. 154(b) by 178 days.

This patent is subject to a terminal disclaimer.

(21) Appl. No.: 13/562,078

(22) Filed: Jul. 30, 2012

(65) Prior Publication Data

US 2014/0076145 A1 Mar. 20, 2014

Related U.S. Application Data

(60) Provisional application No. 61/526,580, filed on Aug. 23, 2011, provisional application No. 61/526,569, filed on Aug. 23, 2011.

(51) Int. Cl.

| | |
|---|---|
| ***F41A 5/02*** | (2006.01) |
| ***F41A 15/14*** | (2006.01) |
| ***F41A 3/78*** | (2006.01) |
| ***F41A 5/18*** | (2006.01) |
| ***F41A 5/26*** | (2006.01) |
| ***F41A 9/29*** | (2006.01) |
| ***F41A 21/48*** | (2006.01) |
| ***F41A 25/12*** | (2006.01) |
| ***F41A 5/34*** | (2006.01) |

(52) U.S. Cl.

CPC ... *F41A 5/02* (2013.01); *F41A 5/26* (2013.01); *F41A 9/29* (2013.01); *F41A 21/481* (2013.01); *F41A 25/12* (2013.01); *F41A 3/78* (2013.01); *F41A 5/18* (2013.01); *F41A 15/14* (2013.01); *F41A 5/34* (2013.01)

USPC ..... 89/191.01

(58) Field of Classification Search

USPC ..... 89/191.01, 191.02, 192, 193, 33.01, 89/33.2, 159, 161, 162, 14.3; 42/75.01, 42/75.02

See application file for complete search history.

(56) References Cited

U.S. PATENT DOCUMENTS 2,718,390 A * 9/1955 Taylor ..... 267/34
2,950,653 A * 8/1960 Harvey ..... 89/185

(Continued)

OTHER PUBLICATIONS

"Field Manual No. 23-65- Browning Machine Gun, Caliber .50 HB, M2" Jun. 19, 1991 entire document.

(Continued)

*Primary Examiner* — Bret Hayes

(74) *Attorney, Agent, or Firm* — Ingrassia, Fisher & Lorenz, P.C.

(57) ABSTRACT

A weapon system includes a receiver and an operating group with a barrel extension arranged to axially translate relative to the receiver. In the firing condition, the op-rod assembly and bolt assembly are driven by the drive spring such that the round is guided into the chamber and the op-rod assembly and bolt assembly are locked to the barrel extension and a forward momentum of the op-rod assembly is imparted to the operating group and the round is fired. A portion of an impulse stops the forward momentum of the operating group. In the recoil condition, the operating group is driven rearward by the remaining portion of the impulse, the gas accelerator imparts additional rearward momentum to the op-rod assembly and bolt assembly and stops rearward momentum of the barrel and barrel extension, and the op-rod assembly and the bolt assembly are stopped by the drive spring.

17 Claims, 26 Drawing Sheets

(56) References Cited

U.S. PATENT DOCUMENTS

| | | | | |
|---|---|---|---|---|
| 4,291,611 | A * | 9/1981 | Wells et al. | 89/47 |
| 4,358,986 | A * | 11/1982 | Giorgio | 89/142 |
| 4,475,438 | A | 10/1984 | Sullivan | |
| 4,505,182 | A * | 3/1985 | Sullivan | 89/132 |
| 4,587,879 | A * | 5/1986 | Savioli | 89/33.25 |
| 5,351,598 | A * | 10/1994 | Schuetz | 89/185 |
| 6,343,536 | B1 | 2/2002 | Rossier et al. | |
| 2005/0081707 | A1 * | 4/2005 | Herring | 89/33.14 |
| 2007/0033851 | A1 * | 2/2007 | Hochstrate et al. | 42/75.01 |
| 2008/0236379 | A1 | 10/2008 | Steimke et al. | |
| 2009/0077852 | A1 | 3/2009 | Steimke et al. | |
| 2009/0120276 | A1 | 5/2009 | Steimke et al. | |
| 2012/0311908 | A1 * | 12/2012 | Kenney et al. | 42/75.02 |

OTHER PUBLICATIONS

PCT Search Report and Written Opinion mailed Apr. 15, 2013 in PCT/US12/49054.

The International Bureau of WIPO, International Preliminary Report on Patentability for International Application No. PCT/US2012/049054, mailed Mar. 6, 2014.

* cited by examiner

WEAPON SYSTEM WITH SHORT RECOIL IMPULSE AVERAGING OPERATING GROUP

PRIORITY CLAIMS

This application claims the benefit of U.S. Provisional Application No. 61/526,569, filed Aug. 23, 2011, and U.S. Provisional Application No. 61/526,580, filed Aug. 23, 2011, each of which is hereby incorporated by reference.

TECHNICAL FIELD

The present invention generally relates to weapon systems, and more particularly relates to automatic weapon systems with short recoil impulse averaging operating groups.

BACKGROUND

The desirability of more powerful, yet smaller, machine guns and other types of automatic weapon systems is increasing. In some conventional weapon systems, operating systems with impulse averaging have been used to mitigate the recoil loads and receiver excitation, particularly in systems that use higher impulse rounds. Typically, these operating systems require fixing the barrel to the operating group to create a relatively massive, long recoil stroke operating group.

There are several drawbacks to these conventional systems. The long stroke excursion of such a large mass may reduce firing rate and add complexity to the weapon. Additionally, such weapons may be sensitive to recoiling mass, and therefore, barrel weight. Moreover, such weapons may be sensitive to variation in friction and gravity effects.

Accordingly, it is desirable to provide improved weapon systems to address these issues. Furthermore, other desirable features and characteristics of the present invention will become apparent from the subsequent detailed description of the invention and the appended claims, taken in conjunction with the accompanying drawings and this background of the invention.

BRIEF SUMMARY

In accordance with an exemplary embodiment, a weapon system is provided for firing a round. The weapon system includes a receiver and an operating group configured to operate the weapon system through a charged condition, a firing condition, and a recoil condition. The operating group includes a barrel extension at least partially housed within the receiver and arranged to axially translate relative to the receiver; an operating rod (op-rod) assembly at least partially housed and arranged to axially translate within the barrel extension in the charge condition, the firing condition, and the recoil condition; and a bolt assembly coupled to the op-rod assembly and at least partially housed and arranged to axially translate within the barrel extension. The system further includes a barrel coupled to the barrel extension and defining a chamber; a gas accelerator with a first end coupled to the barrel and a second end coupled to the op-rod assembly; and a buffer assembly including a drive spring having a first end coupled to the receiver and a second end coupled to the op-rod assembly. In the charged condition, the op-rod assembly and the bolt assembly are retracted against the drive spring. In the firing condition, the op-rod assembly and bolt assembly are driven by the drive spring such that the round is guided into the chamber and the op-rod assembly and bolt assembly are locked to the barrel extension and a forward momentum of the op-rod assembly is imparted to the operating group and the round is fired. A portion of an impulse of the fired round stops the forward momentum of the operating group. In the recoil condition, the operating group is driven rearward by the remaining portion of the impulse of the fired round, the gas accelerator imparts additional rearward momentum to the op-rod assembly and bolt assembly and stops rearward momentum of the barrel and barrel extension, and the op-rod assembly and the bolt assembly are stopped by the drive spring.

In accordance with another exemplary embodiment, a method is provided for firing a weapon. The method includes retracting a bolt assembly and an operating rod (op-rod) assembly relative to a barrel extension against a drive spring; driving the bolt assembly and the op-rod assembly with a forward momentum within the barrel extension such that the bolt assembly chambers a round and contacts the barrel extension, imparting forward momentum to the op-rod assembly, the bolt assembly and the barrel extension such that the round is fired, whereby the firing of the round stops the forward momentum and imparts an impulse of rearward momentum on the op-rod assembly, the bolt assembly, and the barrel extension; guiding gases from the round with a gas accelerator to drive the op-rod assembly rearward and to stop the rearward momentum of the barrel extension; and absorbing the rearward momentum of the op-rod assembly with the drive spring.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. Throughout the specification, the use of the terms "front" or "forward" refer to the muzzle end of the firearm or toward the muzzle, and the terms "aft," "rear," or "rearward" refer to the buttstock end of the firearm or toward the buttstock. Some of the figures discussed below may include a legend clarifying these directions relative to the respective view. Similarly, the use of the term "axial" refers to a direction parallel to the longitudinal axis of the weapon system and the term "radial" refers to a direction perpendicular to the longitudinal axis of the weapon system. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 1:
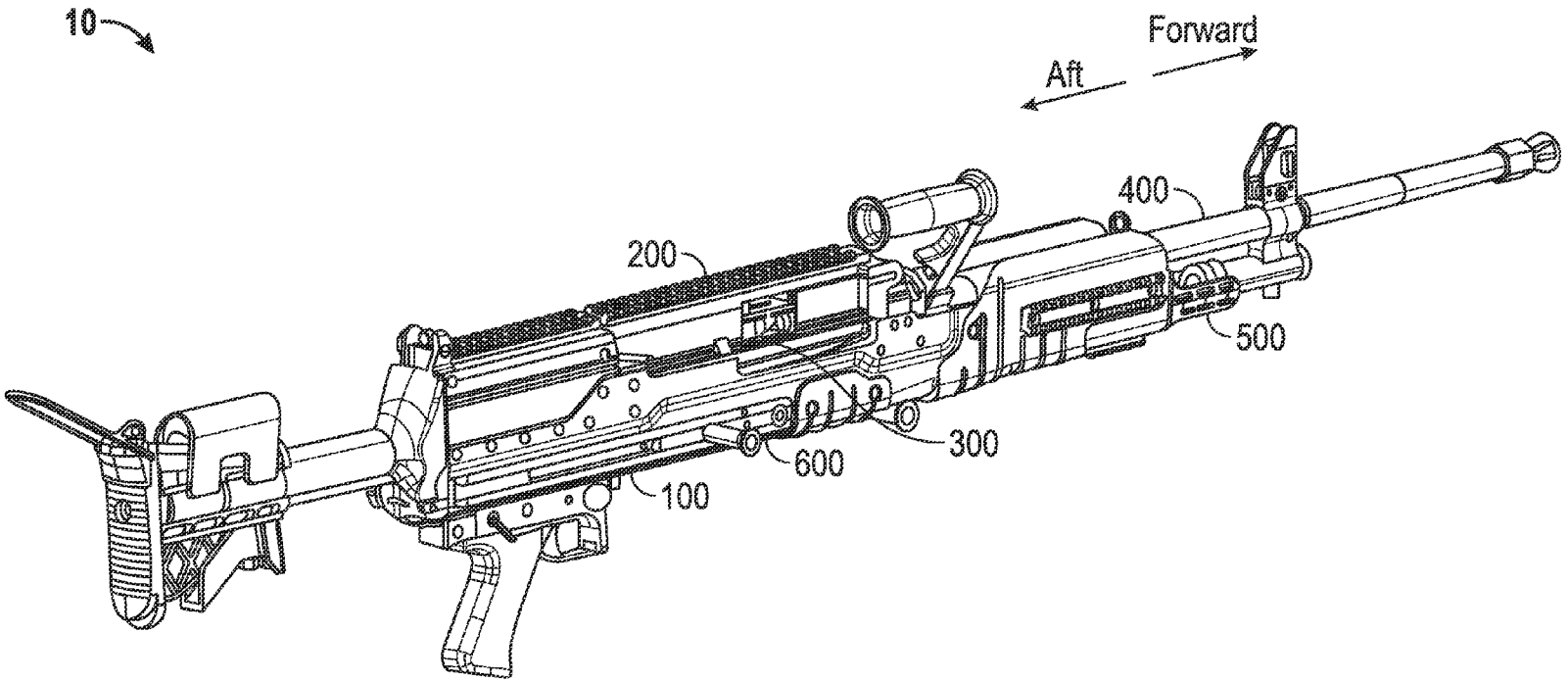
FIG. 1 is an isometric view of a weapon system 10 according to an exemplary embodiment.

FIG. 1 is an isometric view of a weapon system 10 according to an exemplary embodiment. The weapon system 10 generally includes a receiver assembly 100, a feeder assembly 200, an operating group 300, a barrel assembly 400, a gas accelerator 500, and a buffer assembly 600. As described in greater detail below, the components or assemblies of the weapon system 10 cooperate to fire a round according to a short recoil impulse averaging principle of operation. Each of the components or assemblies will be introduced prior to a more detailed explanation of the firing cycle.

Figure 2:
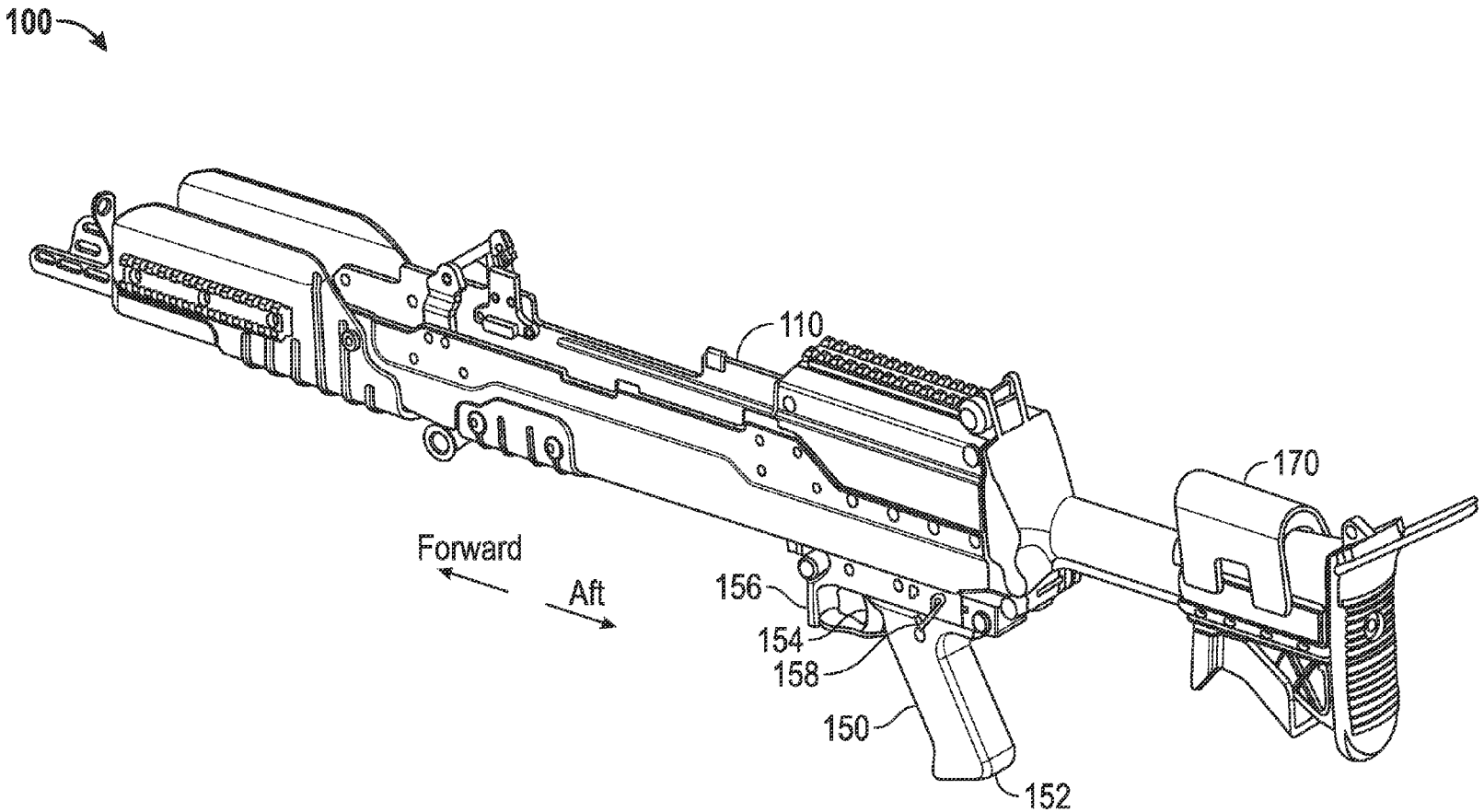
FIG. 2 is an isometric view of a receiver assembly of the weapon system of FIG. 1 according to an exemplary embodiment.

FIG. 2 is an isometric view of the receiver assembly 100 removed from the other components of the weapon system 10 according to an exemplary embodiment. With continuing reference to FIG. 1, in general, the receiver assembly 100 functions to at least partially house the operating group 300 and to provide interfaces for operating the weapon system 10. As shown, the receiver assembly 100 includes a receiver 110, a trigger group 150, and a buttstock assembly 170. The buttstock assembly 170 is mounted onto the aft end of the receiver 110 to provide a rest or brace for the user. The trigger group 150 is mounted on the underside of the receiver 110 to actuate the weapon system 10, as described below. In one exemplary embodiment, the trigger group 150 includes a grip 152, a trigger 154, a trigger guard 156, and a safety lever 158. As discussed below, the trigger 154 is coupled to a sear that selectively engages the operating group 300. As such, when charged, pulling the trigger 154 pivots the sear to release the operating group 300 to initiate firing of the weapon system 10. The trigger group 150 may be configured for automatic or semi-automatic modes.

Figure 3:
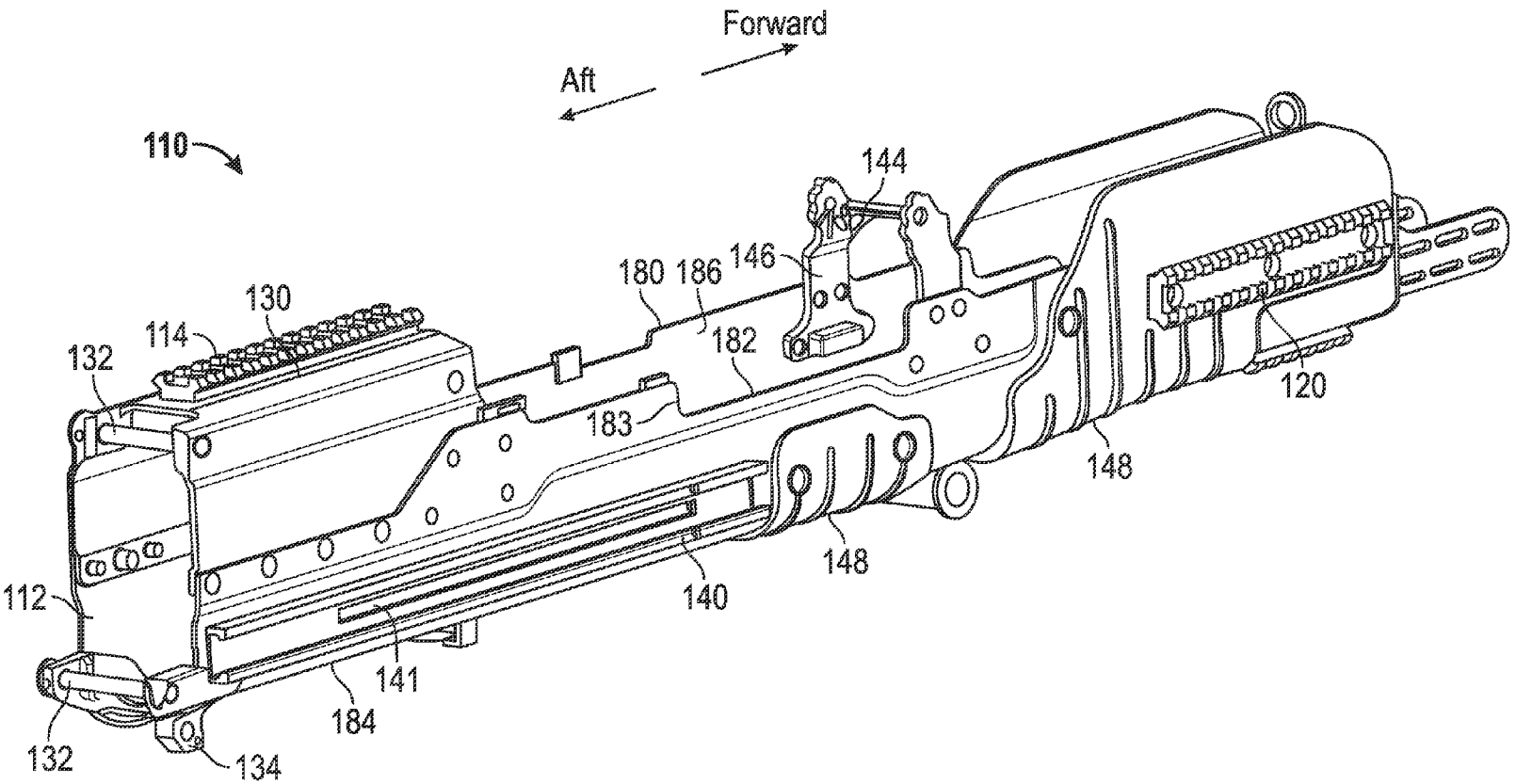
FIG. 3 is an isometric view of a receiver of the receiver assembly of FIG. 2 according to an exemplary embodiment.

FIG. 3 is an isometric view of the receiver 110 removed from the receiver assembly 100 of FIG. 2. As shown, the receiver 110 includes a receiver housing 112, an aft rail 114, forward rails 120, a cover 130, a buttstock interface 132, a trigger interface 134, a charger rail 140, a feeder hinge 144, an operating group guide 146, and first and second grips 148.

With continuing reference to FIGS. 1-2, as described in greater detail below, the receiver housing 112 functions to at least partially house the operating group 300 and to support the other components of the receiver 110. Generally, the receiver housing 112 is U-shaped with two side walls 180, 182 and a bottom wall 184 that define a cavity 186. The cover 130 spans the side walls 180, 182 to at least partially enclose the cavity 186. One or both side walls 180, 182 define a charging port 141 for accommodating actuation of a charger handle (not shown) during operation. Similarly, the charger rail 140 is positioned on the sides of the receiver housing 112 around the charging port 141 to guide movement of the charger handle (not shown). As discussed below, the charger handle is arranged to charge the weapon and initiate the firing cycle. One or both side walls 180, 182 additionally define an ejection window 183.

Still referring to FIG. 2, the buttstock interface 132 is formed on the receiver housing 112 and/or cover 130 to facilitate attachment and detachment of the buttstock assembly 170 relative to the receiver 110. Similarly, the trigger interface 134 provides attachment points to facilitate attachment and detachment of the trigger group 150. Any suitable pin, detent, catch, or other coupling feature may be provided as part of the buttstock and trigger interfaces 132 and 134. As also discussed in greater detail below, the feeder hinge 144 provides an interface for mounting the feeder assembly 200, and the operating group guide 146 provides a radial guide for axial movement of the operating group 300.

The first and second grips 148 are arranged at positions on the receiver housing 112 to provide a comfortable grip for the user. The aft rail 114 is mounted on the cover 130, generally on the top side of the receiver 110, and the forward rails 120 are mounted on the front of the receiver housing 112 with the forward grip 148, generally on the side of the receiver 110, to enable attachment of complimentary weapon system elements.

Figure 4:
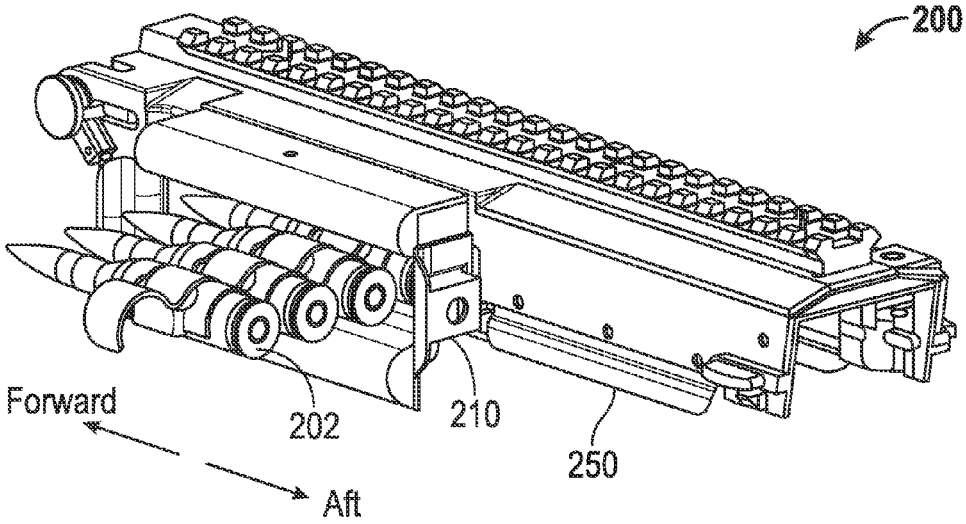
FIG. 4 is a top isometric view of a feeder assembly of the weapon system of FIG. 1 according to an exemplary embodiment.

With continuing reference to FIGS. 1-3, FIG. 4 is a top isometric view of the feeder assembly 200 removed from the other components of the weapon system 10 according to an exemplary embodiment. Generally, the feeder assembly 200 is mounted on the receiver assembly 100 to provide rounds 202 to the operating group 300. The feed assembly 200 includes a feed tray 210 and a feeder 250. As shown in FIG. 4, the feed tray 210 is positioned underneath the feeder 250 such that the feed tray 210 supports and guides a series of rounds 202 indexed by the feeder 250. Consecutive rounds 202 are coupled together by links creating an ammunition belt, and each round 202 typically includes a bullet, a case, a primer, and propellant. The general structure of the feed tray 210 and feeder 250 will be described with reference to FIGS. 5 and 6, and a more detailed description of operation will be discussed below with reference to the firing cycle.

Figure 5:
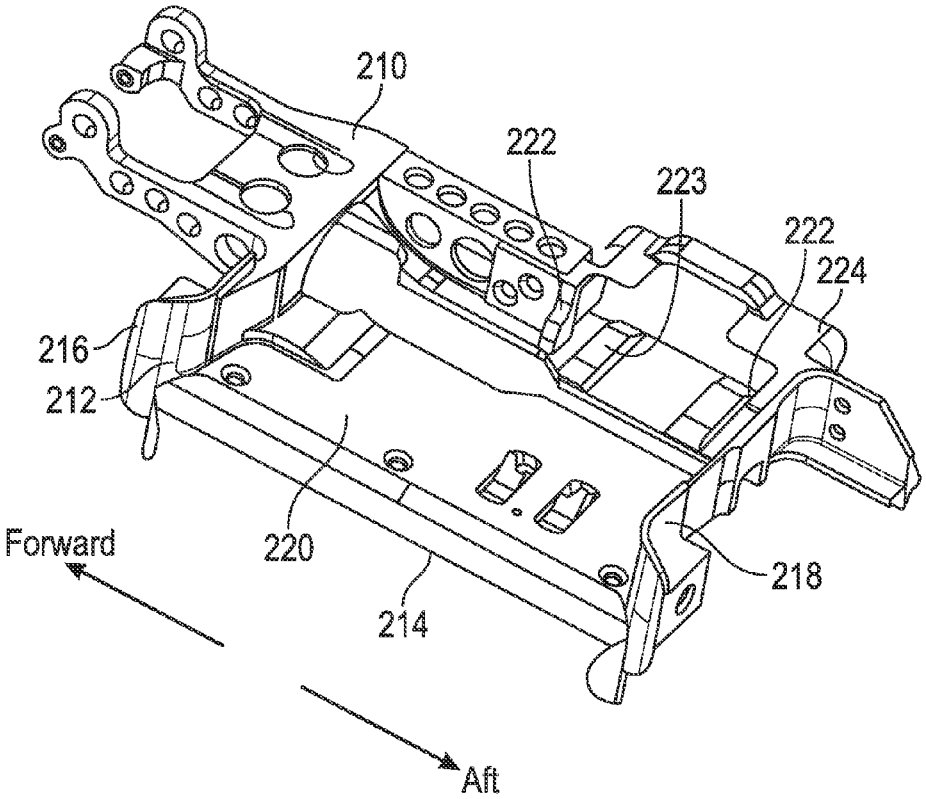
FIG. 5 is a top isometric view of a feed tray of the feeder assembly of FIG. 4 according to an exemplary embodiment.

FIG. 5 is a top isometric view of the feed tray 210 of FIG. 4 in accordance with an exemplary embodiment. The feed tray 210 has a body 212 with side walls 216, 218 and a tray base 220. As shown, the side walls 216, 218 define a bellmouth inlet 214 for receiving the linked rounds 202. During operation, and as discussed in greater detail below, the rounds 202 are indexed through the bellmouth inlet 214, fed to the operating group 300 at round stops 222, and the empty link is ejected through eject guide 224.

Figure 6:
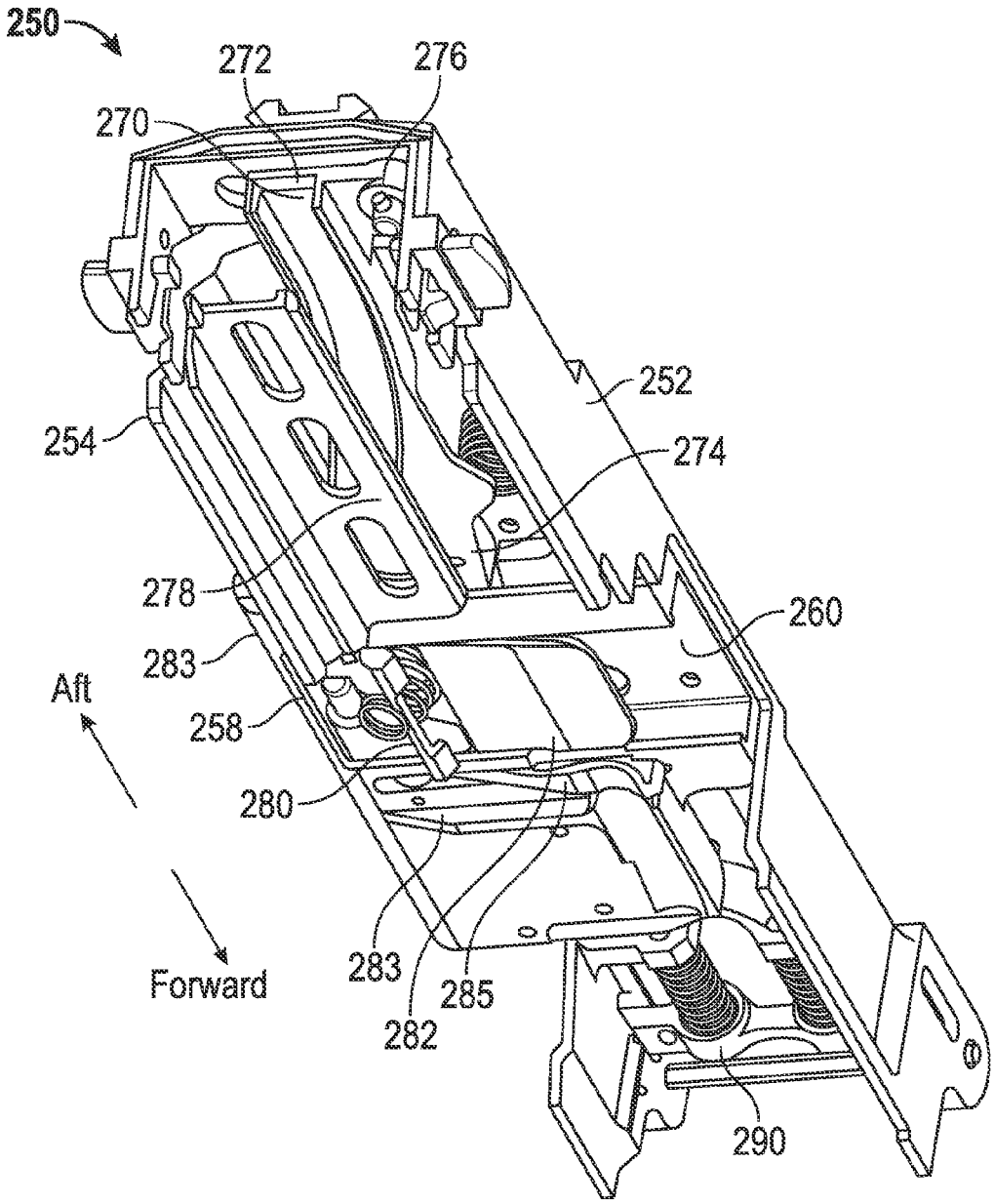
FIG. 6 is an isometric view of the underside of a feeder of the feeder assembly of FIG. 4 according to an exemplary embodiment.
Figure 7:
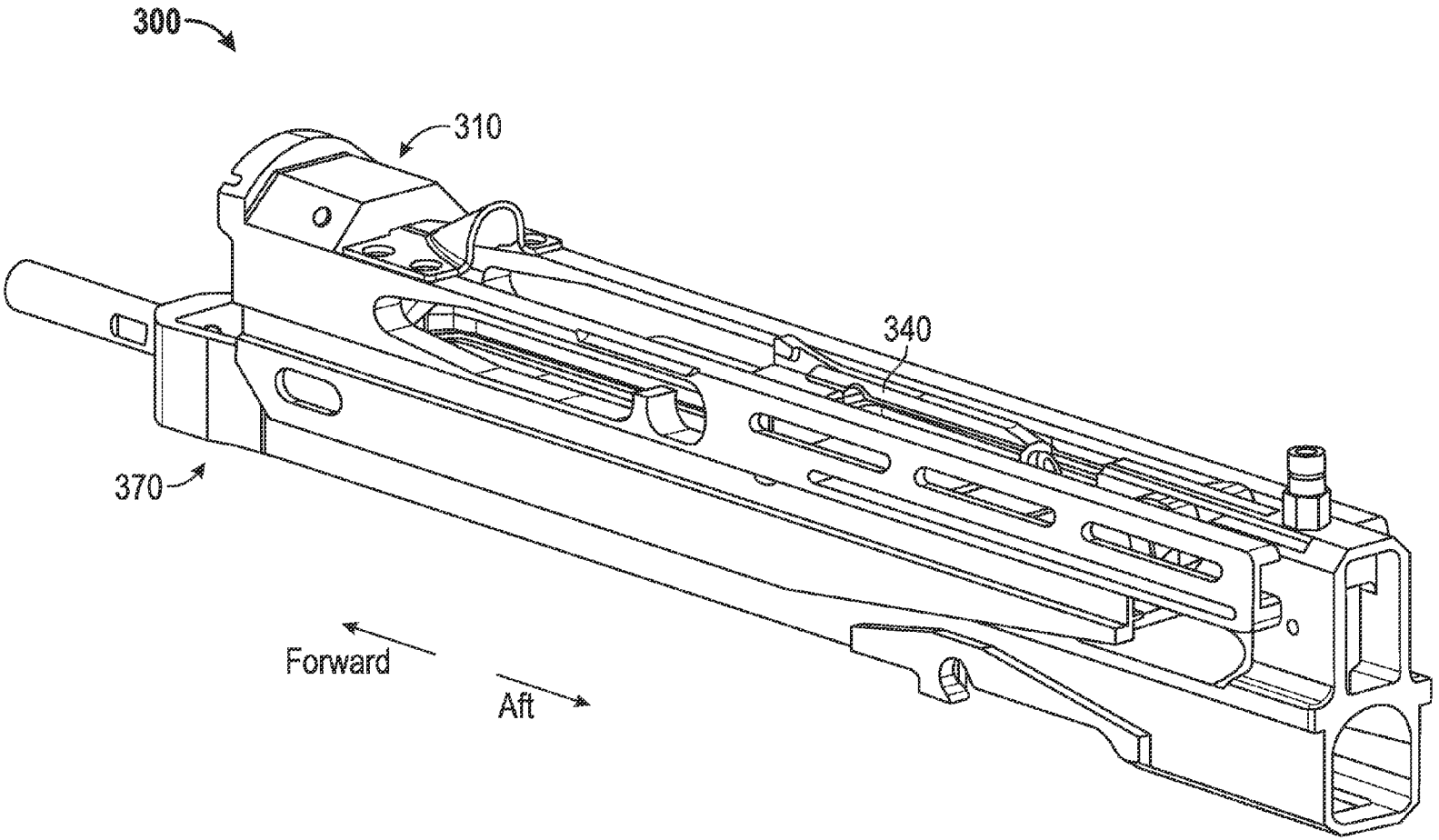
FIG. 7 is an isometric view of an operating group of the weapon system of FIG. 1 according to an exemplary embodiment.

FIG. 6 is an isometric view of the underside of the feeder 250 of FIG. 4 in accordance with an exemplary embodiment. The feeder 250 includes a housing 252 that mates with the receiver assembly 100 and houses the other components of the feeder assembly 200. For example, the housing 252 has side walls 254, 256 defining a feed port 258 and a link eject port 260 that respectively accommodate the inlet 214 and eject guide 224 discussed in reference to FIG. 5. The feeder 250 further includes a feed index cam 270 mounted on the underside of the housing 252 and configured to rotate about pivot 276. The feed index cam 270 includes a cam path 272 and a lever 274 coupled to the cam path 272. A support rail 278 is also mounted to the housing 252 and cooperates to actuate the feed index cam 270 during operation. The lever 274 functions to actuate a drive pawl 280 and feed shuttle 282 mounted to translate laterally on the underside of the housing 252. Forward and aft cartridge guides 283 and cartridge stripping guide 285 are mounted to the underside of the housing 252 to position and guide the rounds 202 indexed through the feeder 250. Cartridge stripping guide 285 also holds the ammunition link to the rear during cartridge ram. FIG. 6 additionally illustrates hinge assembly 290 that interacts with the feeder hinge 144 (FIG. 3) of the receiver assembly 100 (FIG. 1) to pivot the housing 252 during loading operations. Generally, the feeder assembly 200 is sized and located to accommodate the maximum forward and aft positions of the operating group 300 while enabling the bolt to translate beneath it and enabling presentation of rounds 202 approximately one half a cartridge length aft of the barrel for chambering.

With continuing reference to FIGS. 1-6, FIG. 7 is an isometric view of the operating group 300 removed from the other components of the weapon system 10 according to an exemplary embodiment. In general, the operating group 300 functions to position and fire the round 202, eject the cartridge case and empty link, and in cooperation with other components, enable short recoil impulse averaging operation. As described in more detail below, the operating group 300 generally includes a barrel extension 310, a bolt assembly 340, and an operating rod ("op-rod") assembly 370. In one exemplary embodiment, the operating group 300 is at least partially housed in the receiver housing 112 for axial translation. The bolt assembly 340 and op-rod assembly 370 translate within the barrel extension 310, and during various positions discussed below, the barrel extension 310, bolt assembly 340, and op-rod assembly 370 are secured and released from one another for joint or independent movement.

Figure 8:
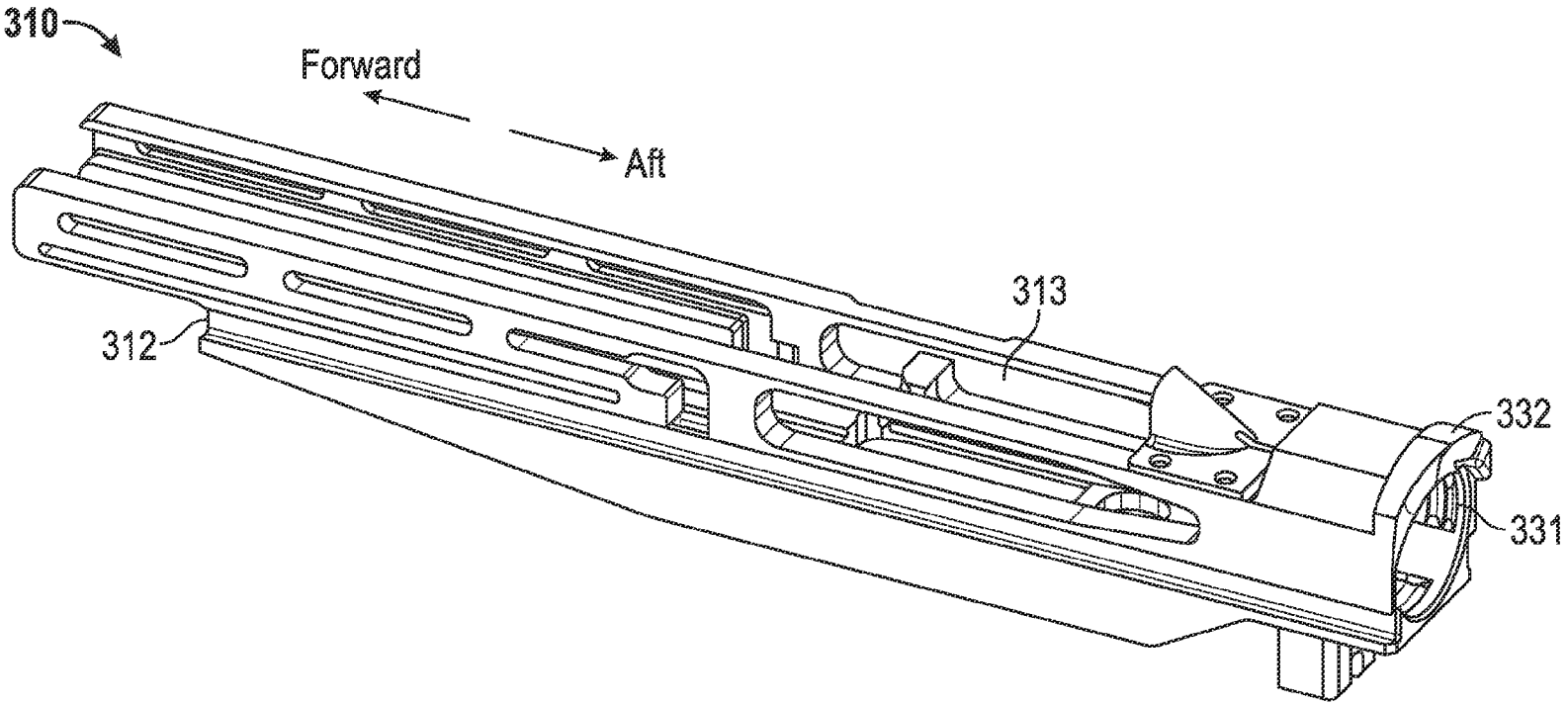
FIG. 8 is an isometric view of a barrel extension of the operating group of FIG. 7 according to an exemplary embodiment.
Figure 9:
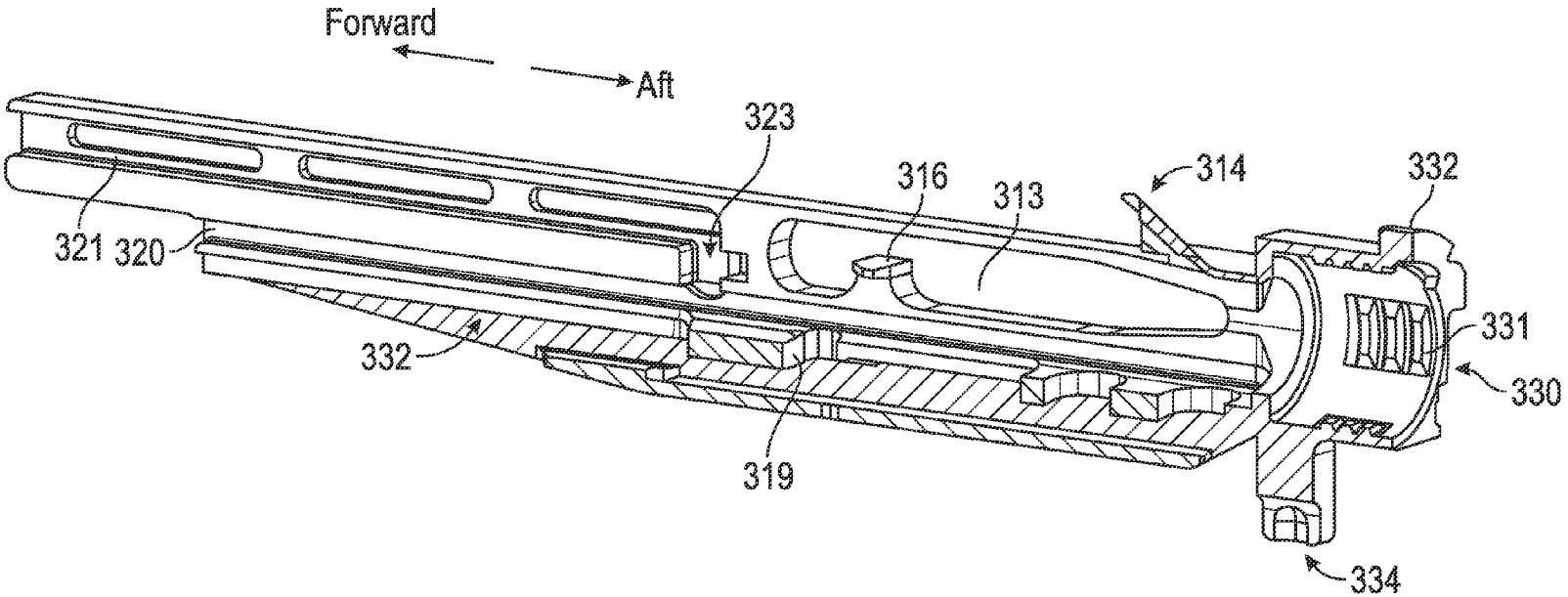
FIG. 9 is a longitudinal cross-sectional view of the barrel extension of FIG. 8 according to an exemplary embodiment.
Figure 10:
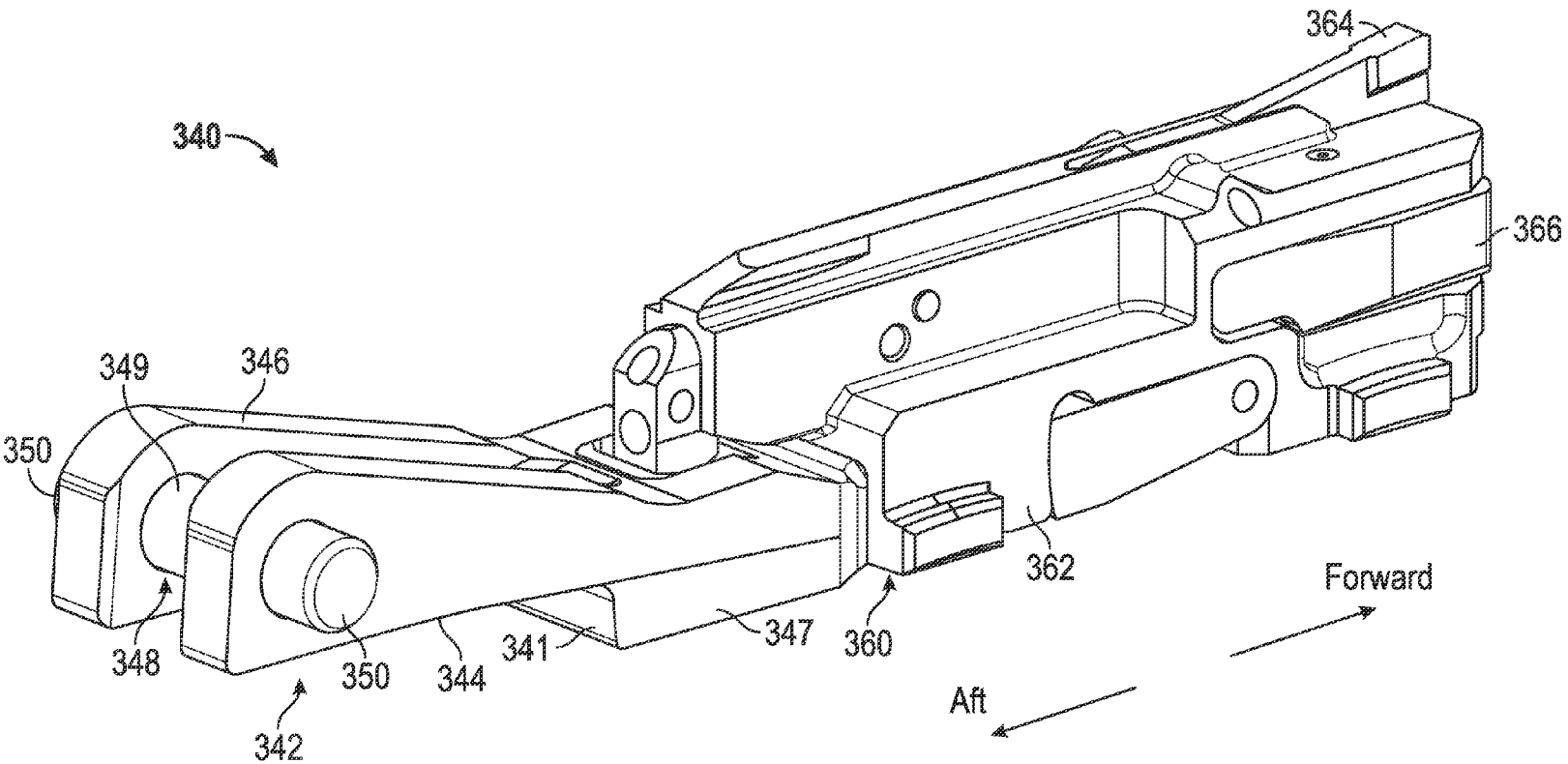
FIG. 10 is an isometric view of a bolt assembly of the operating group of FIG. 7 according to an exemplary embodiment.

FIG. 8 is an isometric view of the barrel extension 310 removed from the other components of the operating group 300 according to an exemplary embodiment, and FIG. 9 is a longitudinal cross-sectional view of the barrel extension 310 of FIG. 8. FIGS. 8 and 9 will be discussed together.

The barrel extension 310 has a number of elements that cooperate with the bolt assembly 340 and op-rod assembly 370, as well as the other components of the weapon system 10, to assist in weapon operation. In general, the barrel extension 310 is mounted within the receiver assembly 100 to move freely forward and aft with little or no resistance to prevent or mitigate energy storage or transfer to the receiver assembly 100.

As shown in FIG. 8, the outer surface of the barrel extension 310 defines longitudinal receiver tracks 312 on opposite sides of the barrel extension 310. The receiver tracks 312 provide an interface for axial translation of the barrel extension 310 relative to the receiver assembly 100. The top side of the barrel extension 310 is generally open to interface with the feed assembly 200, while the underside of the barrel extension 310 is also generally open to receive the bolt assembly 340 and op-rod assembly 370. The side surfaces of the barrel extension 310 define an ejection window 313 that lines up with the ejection window 183 (FIG. 3) of the receiver assembly 100.

As best shown by the cross-sectional view of FIG. 9, the interior surface of the barrel extension 310 defines axially extending bolt tracks 320 to guide the bolt assembly 340 relative to the barrel extension 310. The bolt tracks 320 further define a barrel extension lock 319 extending from the interior surface of the barrel extension 310 that functions to temporarily lock the barrel extension 310 to the bolt assembly 340 during a portion of the firing cycle. The bolt assembly 340 is further guided, as discussed below, by hold-up cams 321 defined in the side surfaces of the barrel extension 310. Each hold-up cam 321 extends in an axial direction and terminates at a cam relief 323 on a forward end. The cam relief 323 extends radially downward relative to the main portion of the hold-up cams 321.

With continuing reference to FIGS. 1-7, as further illustrated in FIGS. 8 and 9, the interior surface of the barrel extension 310 further defines op-rod tracks 322 to guide the rear of the op-rod assembly 370 relative to the barrel extension 310. The forward end of the barrel extension 310 defines a barrel interface 330 for the barrel assembly 400, and a buffer interface 334 for coupling the barrel extension 310 to the buffer assembly 600. The barrel interface 330 includes locking lugs 331 formed on the interior surface of the forward end of the barrel extension 310 and a helix lock surface 332 extending around an upper periphery of the aft end of the barrel extension 310. As such, the locking lugs 331 are raised relative to the interior surface in circumferential sections, and the helix lock surface 332 is a flange defining at least one gap. The locking lugs 331 and helix lock surface 332 cooperate with corresponding elements of the barrel assembly 400 to form a quick release mechanism. The buffer interface 334 is a downwardly extending protrusion that is configured to guide the forward portion of the op-rod assembly 370 and mate with an extension of the buffer assembly 600, which functions to resist axial movement of the barrel extension 310 with little or no return energy. As also shown in FIG. 9 and discussed in greater detail below, the barrel extension 310 further includes a round guide 314 and ejector 316 for respectively guiding a round and round casing during the firing cycle. In particular, the round guide 314 is fixed sloping downward to guide a round 202 presented by the feed assembly 200 into a chamber of the barrel assembly 400 (FIG. 16), and the ejector 316 is fixed, extending radially inward to engage one side of a round case base to rotate the case out of the weapon system 10, as discussed below.

Figure 11:
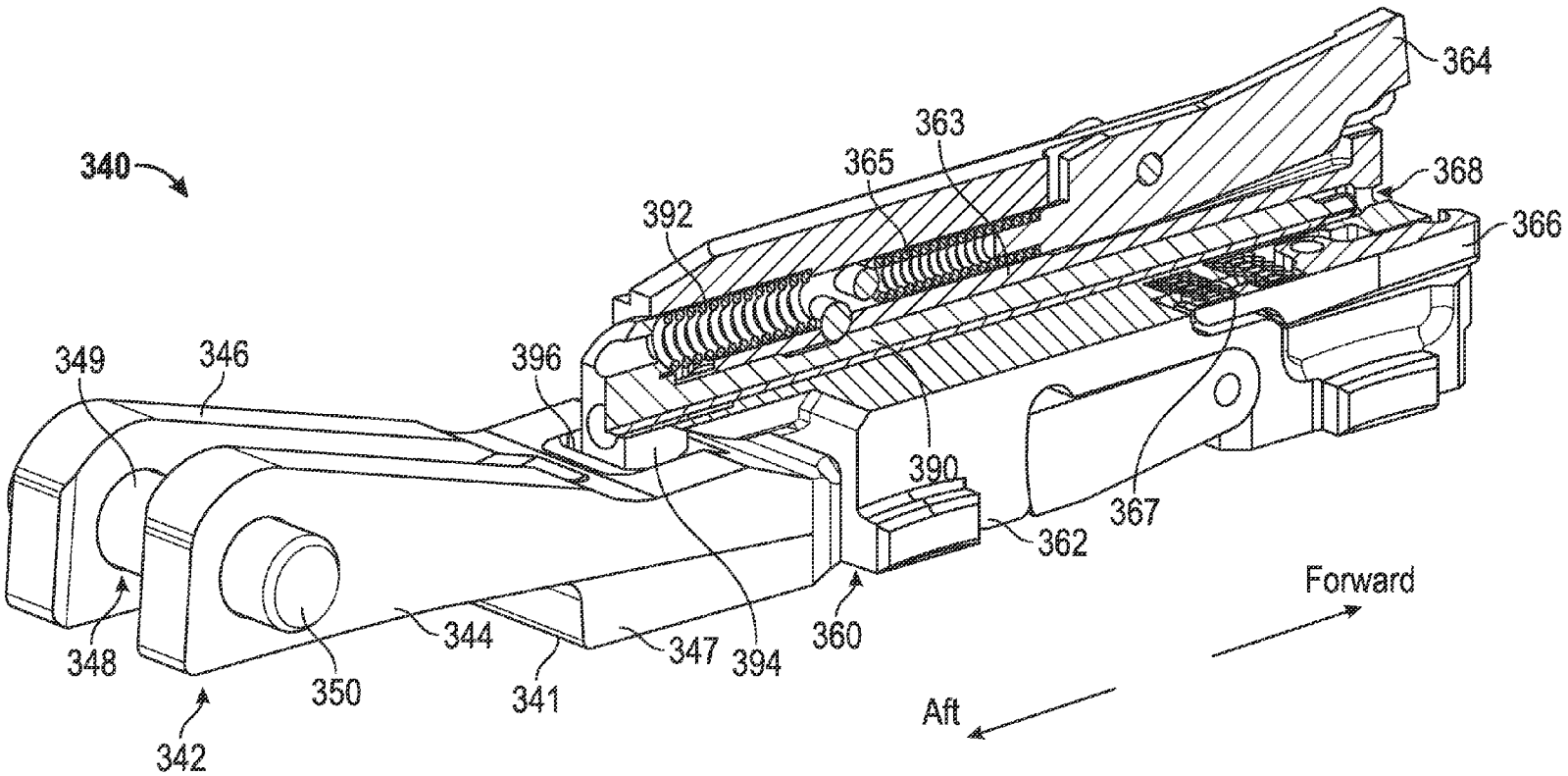
FIG. 11 is a partial cross-sectional isometric view of the bolt assembly of FIG. 10 according to an exemplary embodiment.

With continuing reference to FIGS. 1-9, FIG. 10 is an isometric view of the bolt assembly 340 removed from the other components of the operating group 300 according to an exemplary embodiment, and FIG. 11 is a partial cross-sectional isometric view of the bolt assembly 340 according to an exemplary embodiment. As shown, the bolt assembly 340 includes a lock block 342 coupled to a bolt 360. The bolt assembly 340 generally includes first and second rails 344, 346 extending from a base 347. The base 347 defines a rear face 341 that engages the barrel extension 310 at some positions of the firing cycle.

On one end of the lock block 342, a cam shaft 348 mounted between the two rails 344, 346. The cam shaft 348 includes a central portion 349 between the two rails 344, 346 and end portions 350 extending outside of the two rails 344, 346. As described below, the cam shaft 348 is positioned to engage corresponding cams in the barrel extension 310 and the op-rod assembly 370.

The bolt 360 is coupled to the lock block 342 and generally includes a body 362 with a rammer 364 extending from the top of the body 362 and an extractor 366 mounted on the side of the body 362. The body 362 of the bolt 360 further defines an ejector slot 368. The rammer 364 is mounted in a groove formed in the top side of the bolt 360 to pivot about an axis perpendicular to the bolt axis. A rammer spring 365 biases the rammer 364 in an up-pivoting position. The extractor 366 is mounted in a groove. formed on the bolt 360 so as to pivot about an axis perpendicular to the bolt axis against the bias of an extractor spring (or springs) 367. As described in greater detail below, the rammer 364 functions to position a round for firing, and the extractor 366 guides the case from the fired round on the bolt face until contacted by ejector 316 through the ejector slot 368. The body 362 further defines a firing pin guide 363 for guiding a firing pin 390.

In this exemplary embodiment, the firing pin 390 is housed on in the bolt assembly 340, and a hold spring 392 on the bolt assembly 340 generally holds the firing pin 390 in a retracted position. In the depicted position, partially shown in FIG. 11 and depicted in greater detail in subsequent FIGS, the interaction of a hold cam protrusion 396 extending from the firing pin 390 and a hold cam 394 formed on the inclined surface of the lock block 342 prevents the firing pin 390 from moving forward. During the firing cycle, as described below, the lock block 342 may pivot downward due to the interaction of aft end of the lock block 342 and a forward end of the op-rod assembly 370 and/or due to the interaction of a cam shaft 348 on the lock block 342 and a cam 286 on the op-rod assembly 370. Other embodiments may be arranged differently, such as an embodiment in which a firing pin is mounted on the op-rod assembly.

Figure 12:
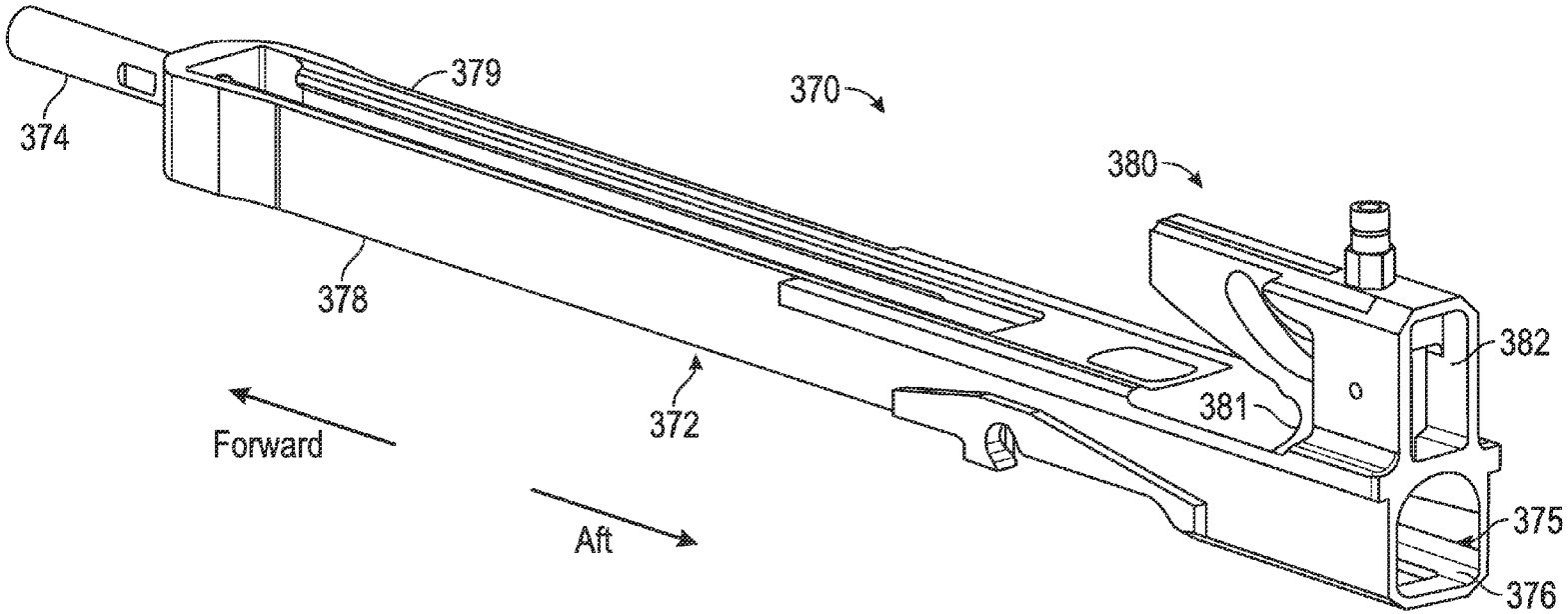
FIG. 12 is an isometric view of an op-rod assembly of the operating group of FIG. 7 according to an exemplary embodiment.
Figure 13A:
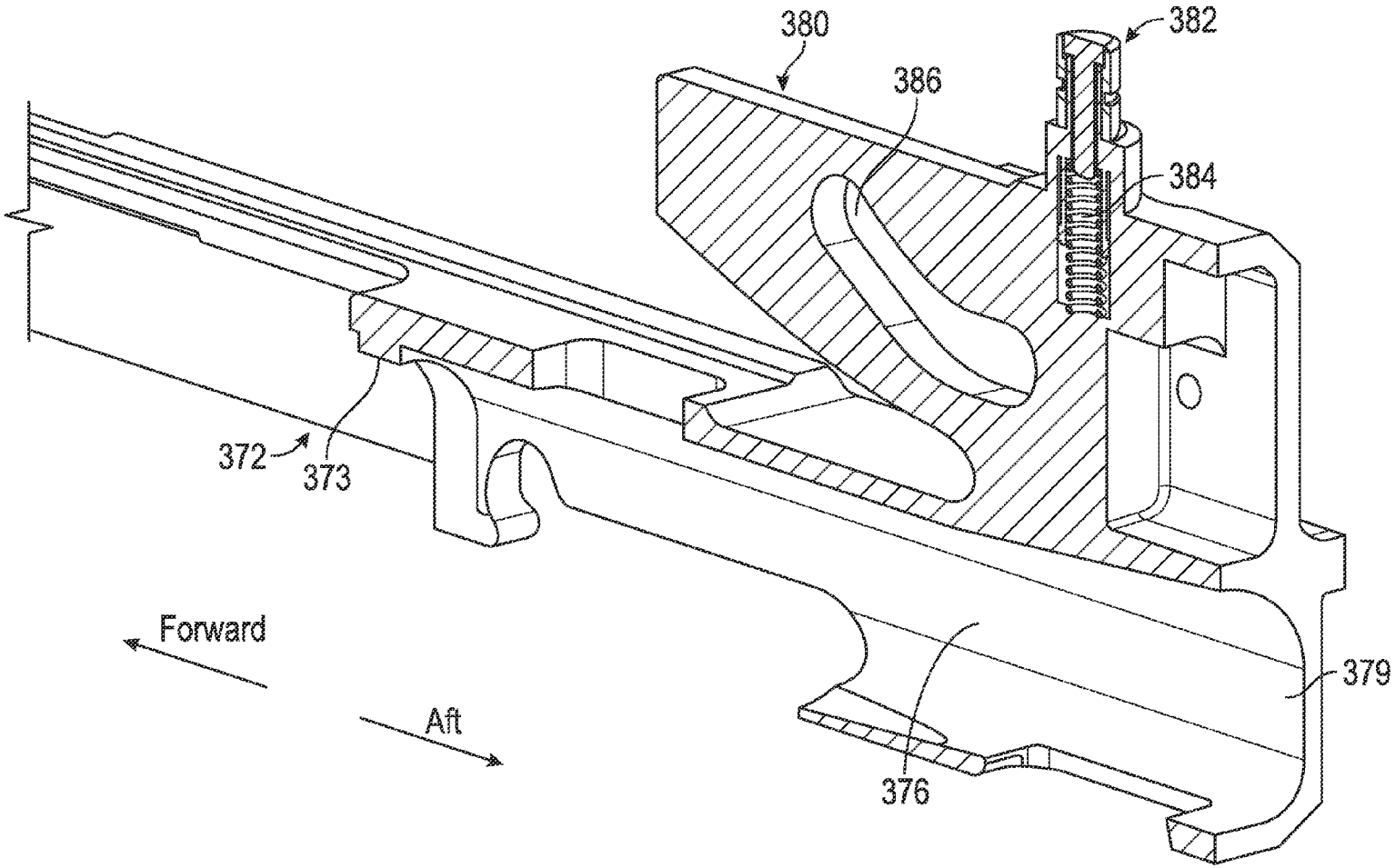
FIG. 13A is a partial longitudinal cross-sectional view of the op-rod assembly of FIG. 12 according to an exemplary embodiment.
Figure 13B:
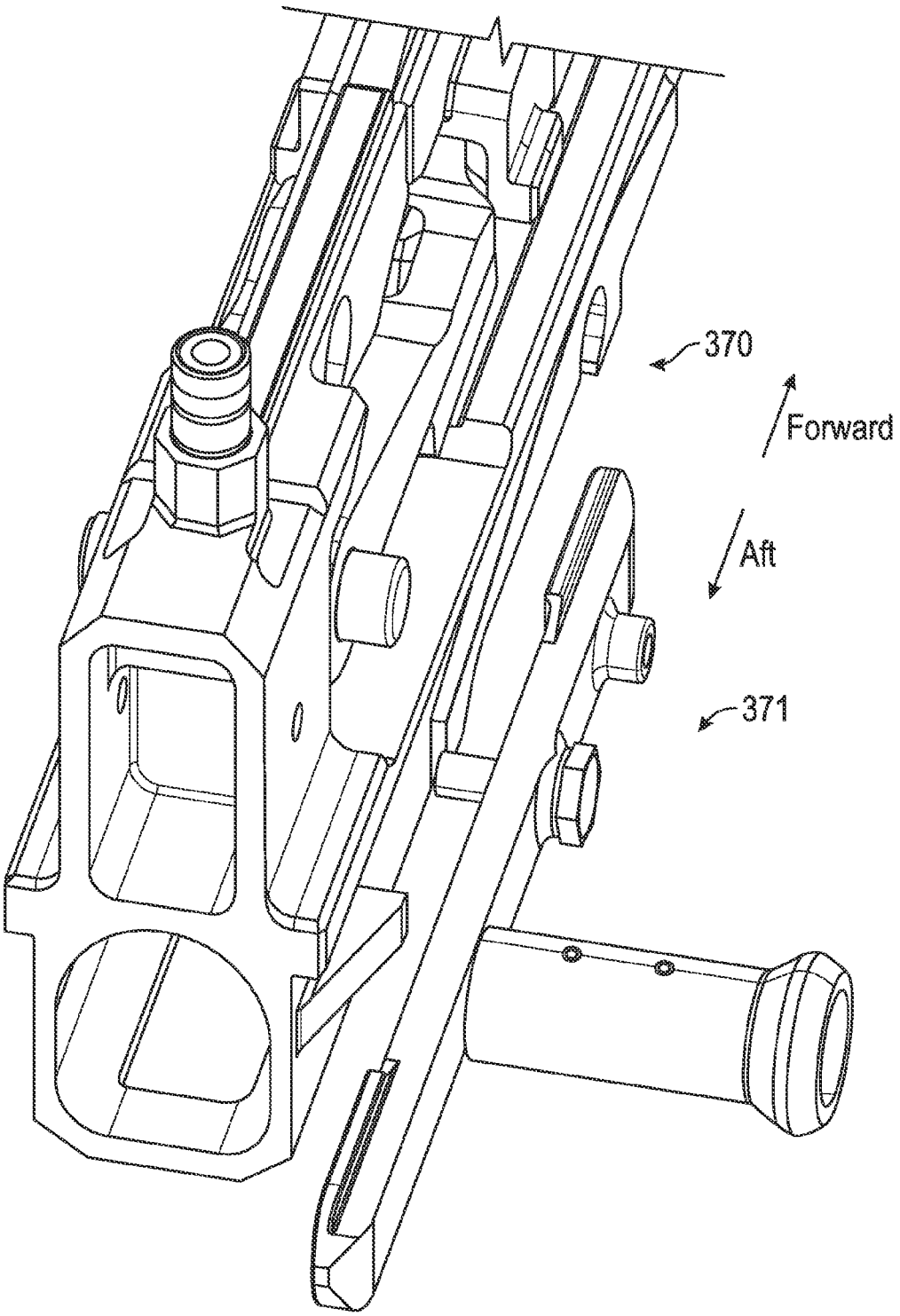
FIG. 13B is a partial end view of the op-rod assembly of FIG. 12 according to an exemplary embodiment.

FIG. 12 is an isometric view of the op-rod assembly 370 removed from the other components of the operating group 300 (FIG. 7) according to an exemplary embodiment. FIG. 13A is a longitudinal cross-sectional view and a partial end view, respectively, of the op-rod assembly 370 of FIG. 12. FIGS. 12, 13A and 13B will be discussed together.

As best shown by FIG. 12, and with continuing reference to FIGS. 1-11, the op-rod assembly 370 has an elongated body portion 372 and a top portion 380 on a top surface of an aft end 375 of the body portion 372. As discussed below, the body portion 372 of the op-rod assembly 370 is generally situated underneath the barrel extension 310. As also discussed below, the body portion 372 includes a forward extension 374 coupled to the gas accelerator 500 and an aft end 375. The aft end 375 is housed within the receiver assembly 100 and accommodates the buffer assembly 600 in a cavity 376 defined by side rails 378, 379. The op-rod assembly 370 is coupled to or otherwise engages a charging handle 371 that extends horizontally from the side of the body portion 372 and out of one of the charging ports 141 of the receiver assembly 100, as particularly shown in FIG. 13B. The charging handle 371 enables an operator to translate the op-rod assembly 370 in a rearward direction to charge the weapon system 10 in preparation for firing.

The top portion 380 of the op-rod assembly 370, as best shown in FIG. 13A, includes an upwardly extending feed roller 382 mounted on a roller shaft 384. As also shown in FIG. 13A and discussed in more detail below, the op-rod assembly 370 includes a spring retainer 371 to engage a drive spring (e.g., drive spring 670 in FIG. 17). The top portion 380 further defines a cam 386 for interacting with other components of the operating group 300. Additionally, the top portion 380 has a forward face 381 that functions as a forward stop surface relative to the bolt assembly 340 during operation, and an aft face 382 that functions as an aft stop surface relative to the buffer assembly 600 during operation. In general, the op-rod assembly 370 has a relatively long excursion compared to the barrel extension 310 during operation.

In this exemplary embodiment, a firing pin 388 is mounted in the bolt assembly 340, although in other embodiments, a firing pin may be positioned on other components. The feed roller 382, cam 386, and firing pin 388 will be discussed in greater detail below in the description of the firing and feed cycles.

Figure 14:
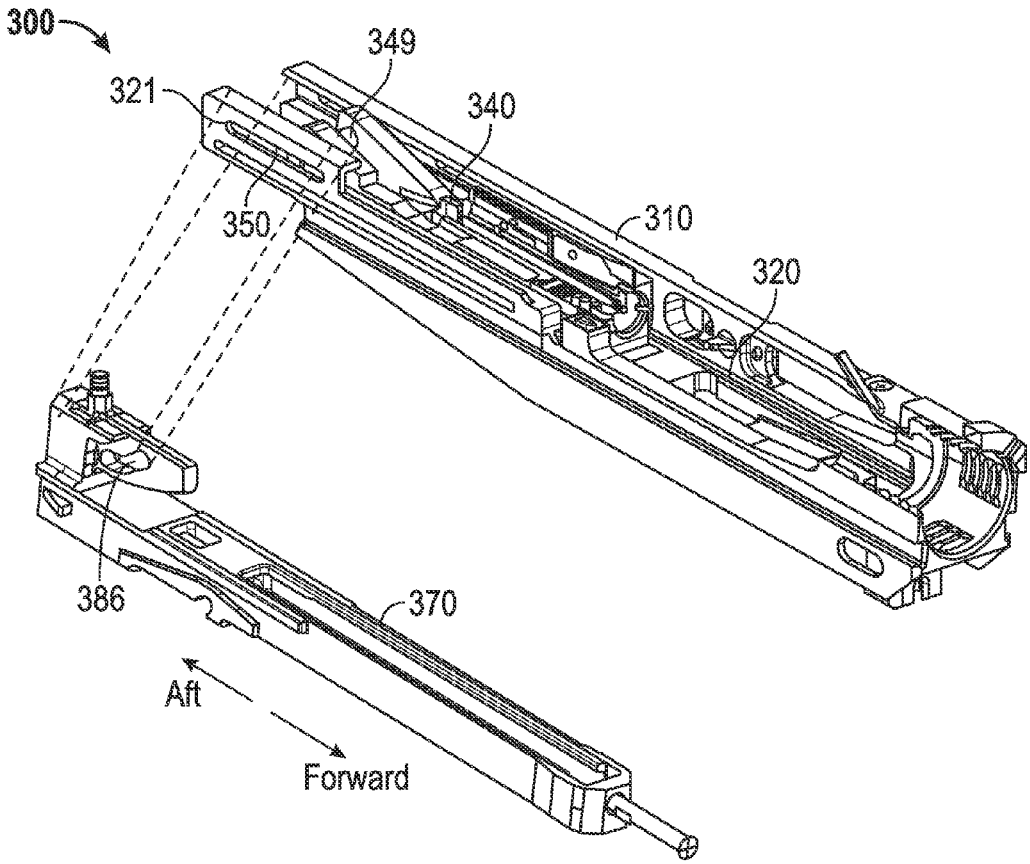
FIG. 14 is an exploded isometric, partially cross-sectional view of the operating group of FIG. 7 according to an exemplary embodiment.

FIG. 14 is an exploded isometric, partially cross-sectional view of the operating group 300 and more clearly shows the interaction of the barrel extension 310, the bolt assembly 340, and the op-rod assembly 370. As introduced above, the bolt assembly 340 is configured to translate within the barrel extension 310 on bolt tracks 320. As described below, during portions of the firing cycle, the cam shaft ends 350 of the bolt assembly 340 are positioned within the hold-up cam 321. As indicated by the dashed lines, the central portion 349 of the cam shaft 348 is positioned within the cam 386 of the op-rod assembly 370. As a result of this arrangement, the cams 321, 386 cooperatively guide the position of the bolt assembly 340 during the op-rod 370 translation through the barrel extension 310.

Figure 15:
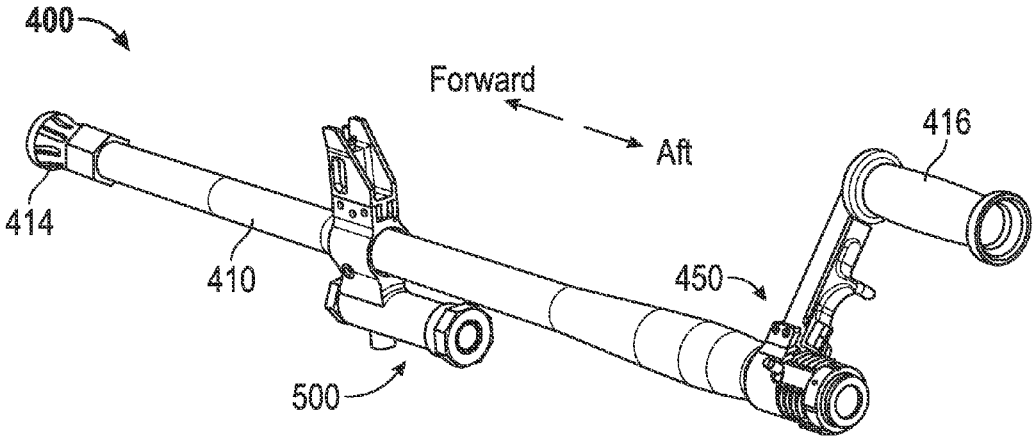
FIG. 15 is an isometric view of a barrel assembly and a gas accelerator of the weapon system of FIG. 1 according to an exemplary embodiment.
Figure 16:
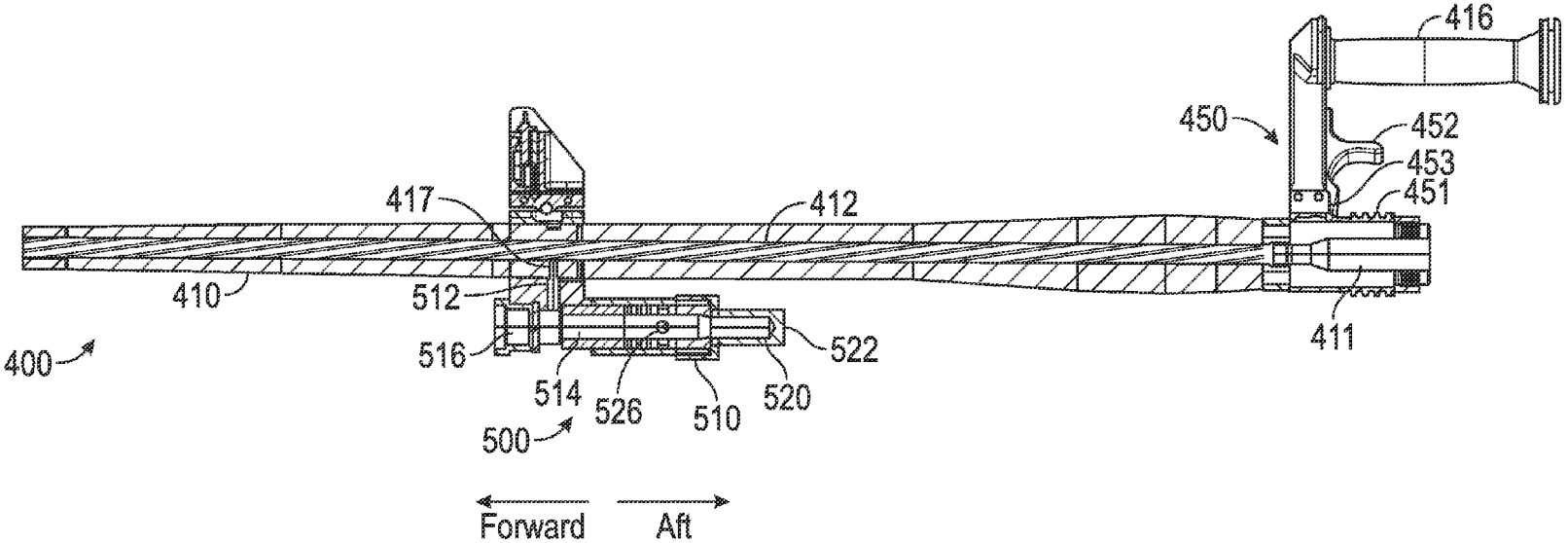
FIG. 16 is a cross-sectional view of the gas accelerator of FIG. 15 according to an exemplary embodiment.

FIG. 15 is an isometric view of the barrel assembly 400 and the gas accelerator 500 removed from the other components of the weapon system 10 according to an exemplary embodiment, and FIG. 16 is a cross-sectional view of the gas accelerator 500 according to an exemplary embodiment. The barrel assembly 400 generally includes a barrel 410 defining a chamber 411 and a bore 412 for guiding a fired round out of the weapon system 10 (FIG. 1). A flash suppressor 414 or other ancillary device may be mounted on the forward end of the barrel 410, and a barrel handle 416 and a release (or quick-release) mechanism 450 may be mounted on the aft end of the barrel 410 for coupling and decoupling the barrel assembly 400 to the barrel extension 310 (FIG. 8). In general, the release mechanism 450 includes barrel locking lugs 451 extending in partial helix sections around the outer surface of the aft end of the barrel sleeve, which is able to rotate about the barrel axis through a sector from locked to unlocked positions. The release mechanism 450 also includes a barrel lock 452 and lock projection 453 mounted for radial actuation on the barrel handle 416. Although not shown, the release mechanism 450 includes a locking spring housed in the barrel handle 416 that biases the barrel lock 452 and the lock projection 453 downward, towards the chamber 441. The release mechanism 450 is discussed in greater detail below with reference to FIG. 26.

The gas accelerator 500 is mounted on the barrel 410. Particularly, as best shown in FIG. 16, the gas accelerator 500 has a housing body 510 with an inlet 512 fluidly coupled to the bore 412 via a port 417 in the barrel 410. The inlet 512 is fluidly coupled to a chamber 514 defined by the body 510. A vented cap 516 covers one end of the chamber 514. A poppet valve 520 defines the other end of the chamber 514 and is positioned to axially translate within the body 510. An end portion 522 of the poppet valve 520 is configured to be coupled to op-rod assembly 370. The poppet valve 520 and/or body 510 may define vents 526. As the poppet valve 520 moves forward and aft through the body 510, at least some of the gas within the body 510 may be forced out of the vents 526, thereby preventing or mitigating stagnant gases and the accumulation of dirt or debris in the gas accelerator 500.

As shown, in the illustrated exemplary embodiment, the gas accelerator 500 is arranged completely outside of the receiver assembly 100. In this respect, the gas accelerator 500 may be considered self-cleaning since the vents 526 of the poppet valve 520 do not vent gas from the barrel 410 into the interior of the receiver assembly 100. This prevents dirt and other debris from fouling the receiver assembly 100 and/or operating group 300. Additional details about the operation of the gas accelerator 500 are discussed below.

Figure 17:
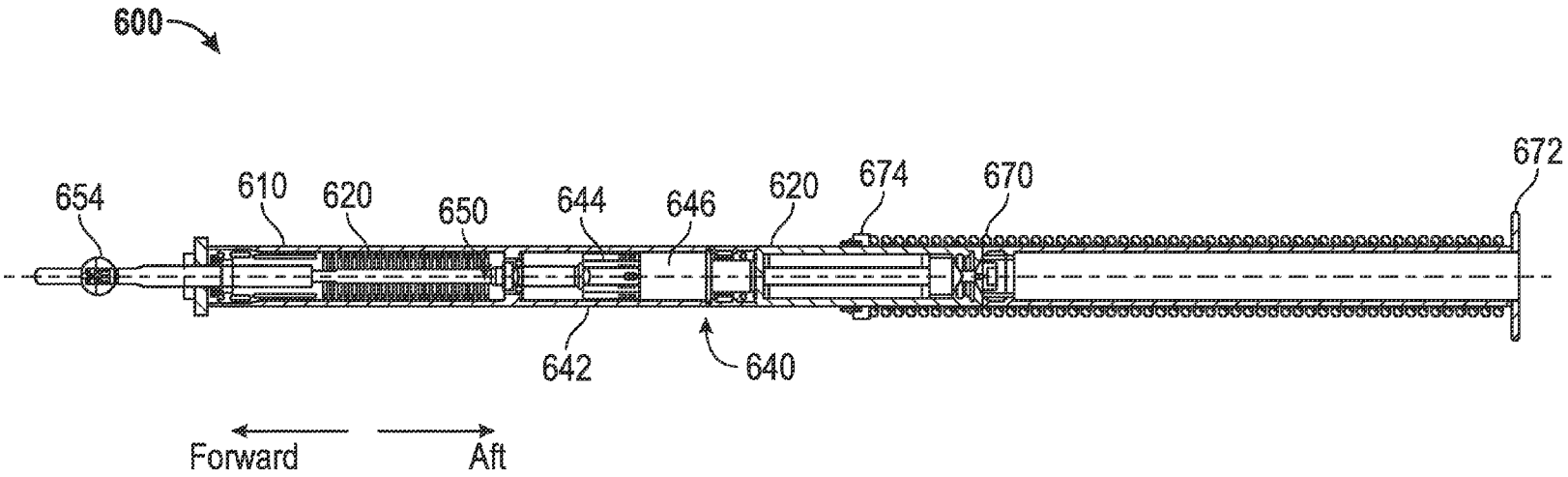
FIG. 17 is a cross-sectional view of a buffer assembly of the weapon system of FIG. 1 according to an exemplary embodiment.

FIG. 17 is a cross-sectional view of the buffer assembly 600 in accordance with an exemplary embodiment. As described in greater detail below, the buffer assembly 600 axially couples the barrel extension 310 to the receiver assembly 100 to generally prevent or mitigate transfer of energy between the operating group 300 (and barrel assembly 400) and the receiver assembly 100. The buffer assembly 600 includes a housing 610 that houses a centering spring 620 and a piston assembly 640. In general, the centering spring 620 is a preloaded double acting spring which functions as bias spring keeping the barrel Extension in the same position under static loading and provide an energy absorption mechanism that tends to mitigate energy storage or return during firing when the preload is exceeded.

A piston rod 650 extends in a forward direction through and out of the housing 610 to couple the buffer assembly 600 to the barrel extension 310 via an attachment ball 654 at buffer interface 334 (FIG. 9). The piston assembly 640 includes a piston 642 with fluid conduits 644 configured to translate within a chamber 646 containing hydraulic fluid. The hydraulic fluid flows through the conduits 644 to resist movement based on the velocity of the piston 642. At higher velocities, the resistance is increased. The position of the piston 642 within the chamber 646 is generally maintained by self-centering spring 620 arranged on the piston rod 650. The piston rod 650 additionally extends out of the housing 610 to couple the buffer assembly 600 to the barrel extension 310 (FIG. 1) via an attachment ball 654.

The buffer assembly 600 further includes a drive spring 670 mounted on the housing 610. One end 672 of the drive spring 670 is coupled to the receiver assembly 100 (FIG. 2), and the other end 674 engages the op-rod assembly 370 (FIG. 12). The forward end 674 of the drive spring 670 contacts the spring retainer 373 (FIG. 13A) which engages and biases the op-rod assembly 370 forward such that the op-rod assembly 370 may be translated in a rearward direction to charge the weapon system and initiate the firing cycle, as will now be discussed.

As an introduction, the firing cycle may be summarized as follows, with continuing reference to FIGS. 1-17: 1) the barrel assembly 400 with the barrel extension 310, the op-rod assembly 370, and the bolt assembly 340 are generally arranged to translate axially relative to the receiver assembly 100; 2) the op-rod assembly 370 and bolt assembly 340 are charged rearward and driven forward by the drive spring 670; 3) the bolt assembly 340 chambers the round 202, unlocks from the op-rod assembly 370, locks to the barrel extension 310, and transfers forward momentum to the barrel extension 310; 4) the op-rod assembly 370 transfers forward momentum to the barrel extension 310 and fires the round; 5) the forward momentum of the barrel extension 310, the op-rod assembly 370, and the bolt assembly 340 are stopped by the round impulse and driven rearward; 6) the gas accelerator 500 drives the op-rod assembly 370 rearward and stops the rearward momentum of the barrel extension 310; and 7) the op-rod assembly 370 is stopped by the drive spring 670 and any extra energy of the op-rod is stopped by impacting the buffer ball 654 and transferring that energy to the barrel extension. Any excessive energy due to impulse imbalance or op-rod transfer energy on the barrel extension 310 is stopped by the buffer assembly 600. This energy balance occurs with little or no energy being transferred to the receiver assembly 100, and thus, the operator. A more detailed description of the firing cycle will be provided with the assistance of FIGS. 18A, 18B and 19-24.

Figure 18A:
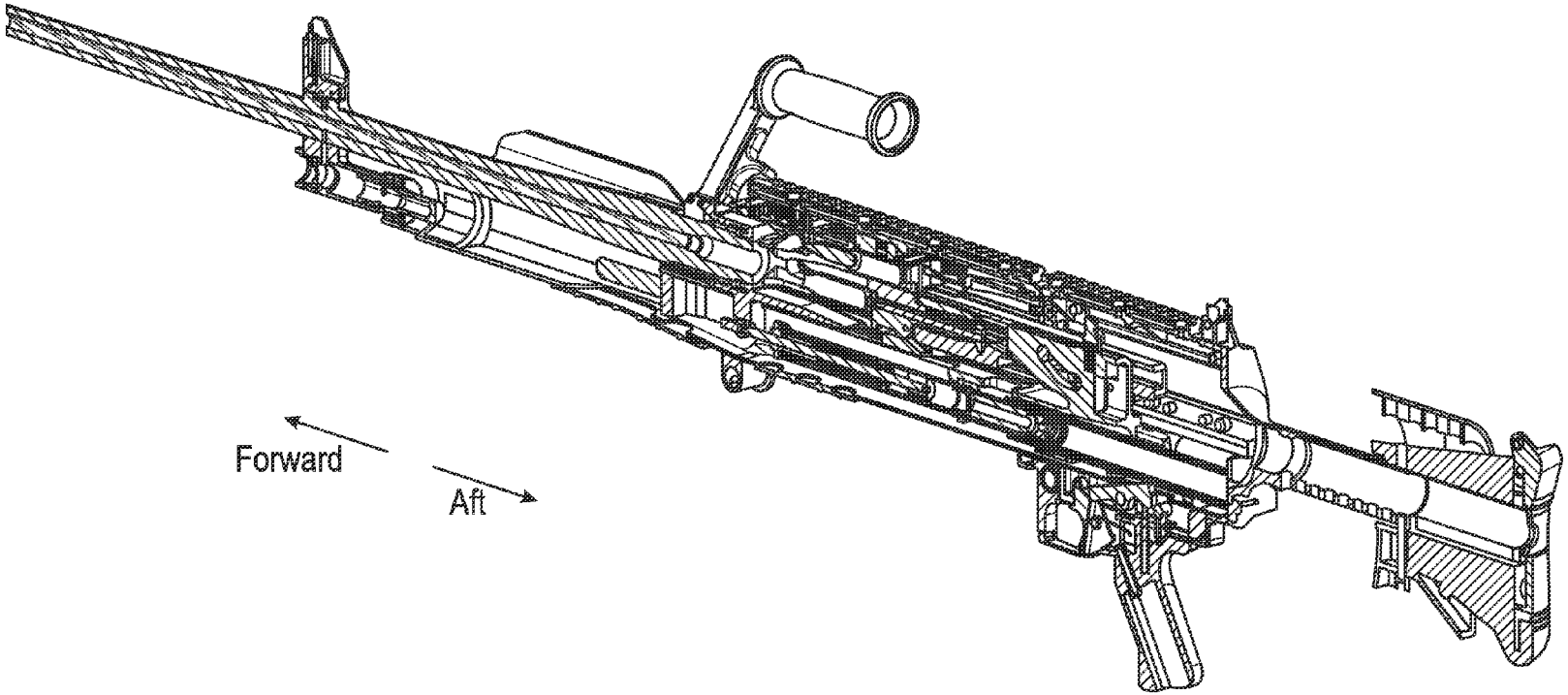
FIGS. 18A, 18B, and 19-24 are partial cross-sectional views of the weapon system of FIG. 1 in various positions of an exemplary firing cycle.

FIG. 18A is a complete cross-sectional view of the weapon system 100 described below. FIGS. 18B and 19-24 are partial, more detailed cross-sectional views of the weapon system 10 in various positions during the firing cycle. FIGS. 18B and 19-24 will be discussed consecutively below. In the discussion of FIGS. 18B and 19-24, reference is additionally made to FIG. 25, which is a graph depicting velocity over time for the barrel group (e.g., which, in the discussion below includes barrel assembly 400 and barrel extension 310), the bolt assembly 340, and the op-rod assembly 370 with velocity represented on the vertical axis and time represented on the horizontal axis. Line 2510 represents the velocity of the barrel group; line 2520 represents the velocity of the bolt assembly 340; and line 2530 represents the velocity of the op-rod assembly 370. The velocities of the barrel group, bolt assembly 340, and the op-rod assembly 370 at various times, labeled as points 2550-2557, will be discussed with respect to the positions depicted in FIGS. 18-18B and 19-24.

Figure 18B:
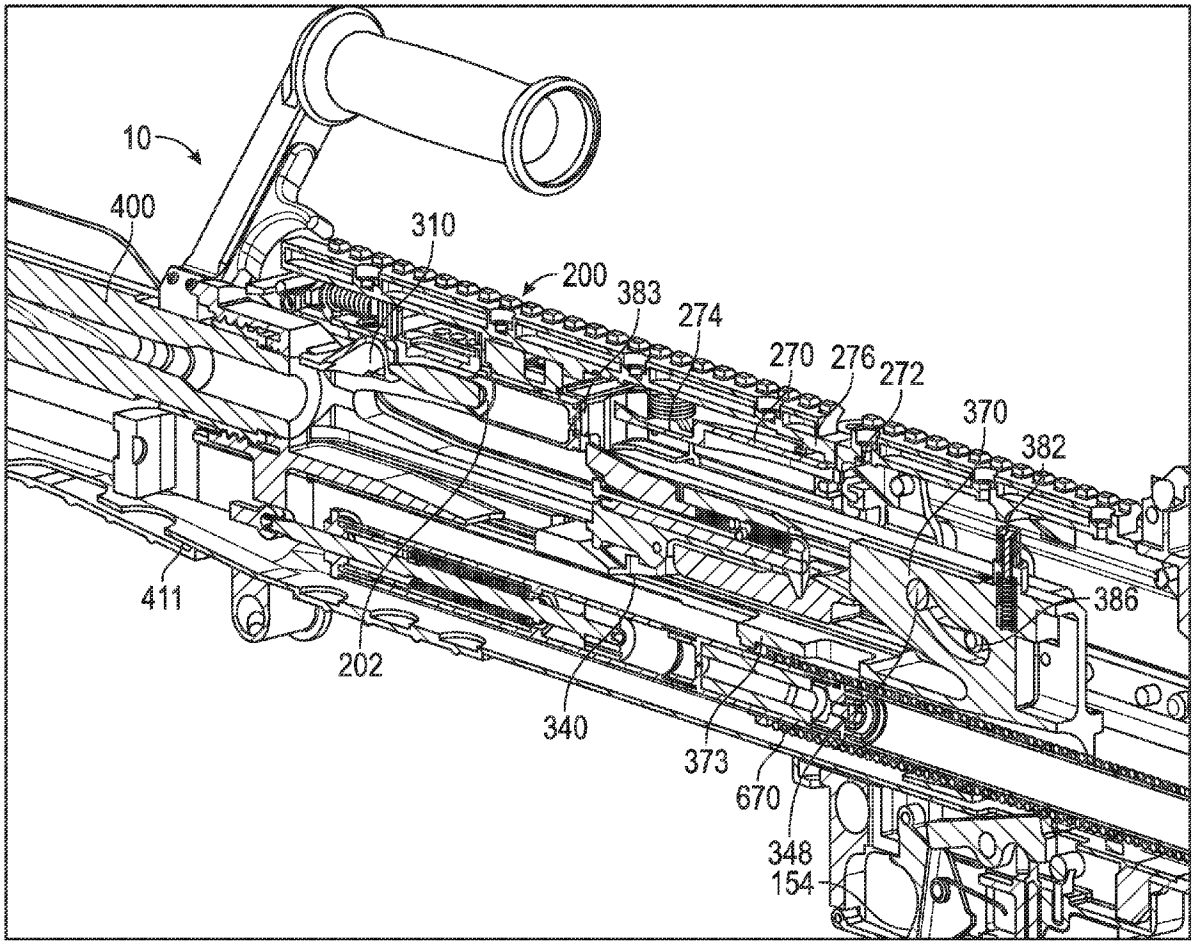

FIG. 18B is a partial cross-sectional view of the weapon system 10 in a first position of a firing cycle according to an exemplary embodiment. The position depicted in FIG. 18B may be considered a charged condition.

Figure 25:
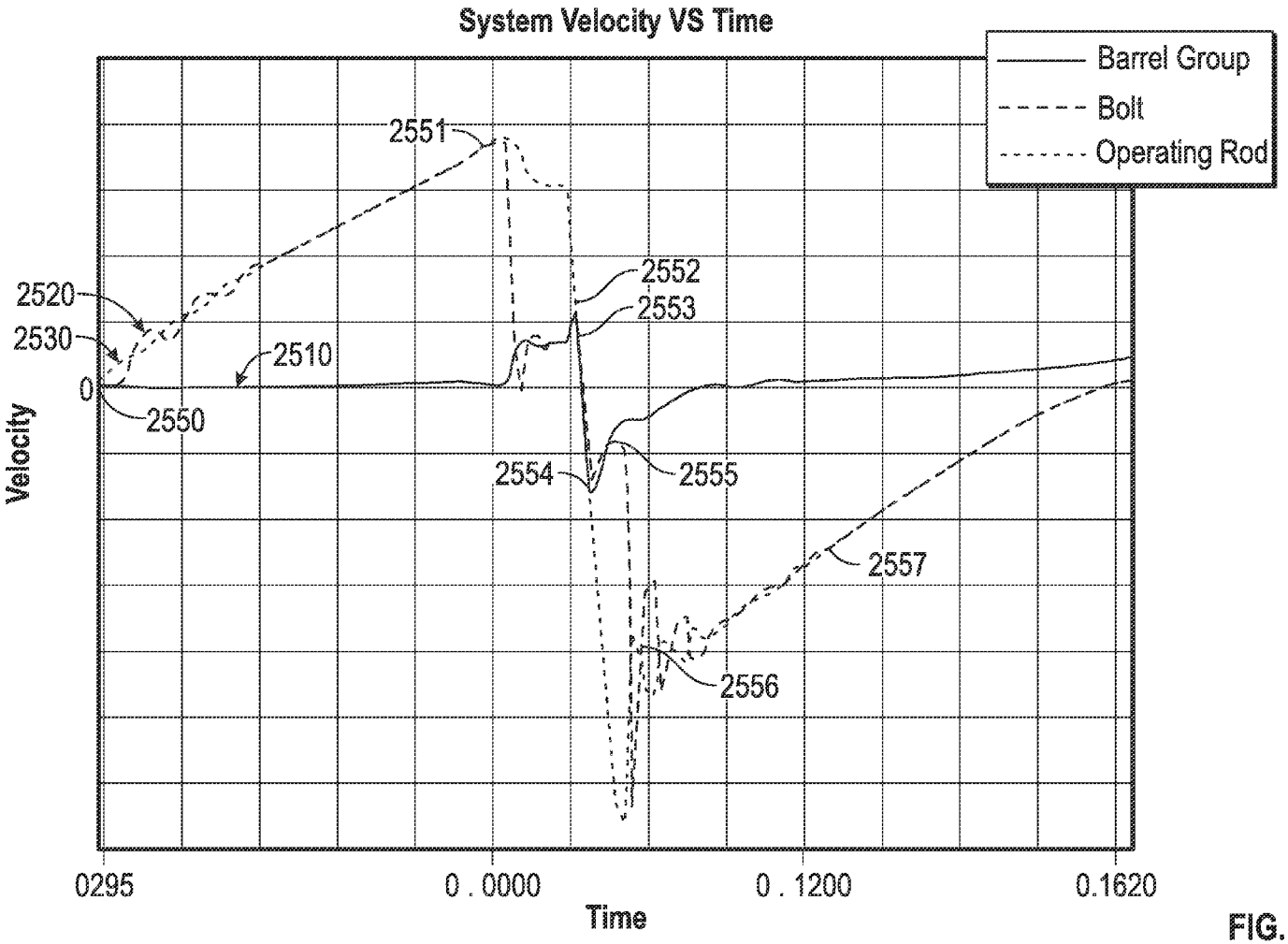
FIG. 25 is a graph depicting velocity over time during the firing cycle depicted in FIGS. 18B-24 according to an exemplary embodiment.

In the first position of FIG. 18B, represented by point 2550 in FIG. 25, the op-rod assembly 370 and the bolt assembly 340 of the operating group 300 have been retracted relative to the barrel extension 310 to charge the weapon system 10. Specifically, the charging handle 371 (FIG. 12) has been pulled rearward by an operator, toward the buttstock assembly 170, thus retracting the op-rod assembly 370. As noted above, the op-rod assembly 370 engages the drive spring 670 via the spring retainer 373 to compress the drive spring 670 as the op-rod assembly 370 retracts. In this position, the round 202 is arranged by the feed assembly 200 laterally in line with the chamber 411 and held in position by the cartridge stop 222 and cartridge hold pawls 223.

As also noted above, the cam shaft 348 engages the cam 386 of the op-rod assembly 370 such that the bolt assembly 340 retracts with the op-rod assembly 370. In this position, the bolt assembly 340 is "locked" or otherwise secured to the op-rod assembly 370. Although not shown in FIG. 18, the op-rod assembly 370 and thus, the bolt assembly 340, are held in the refracted position by a sear 1800 that engages the op-rod assembly 370 and that may be released by the trigger 154.

Figure 19:
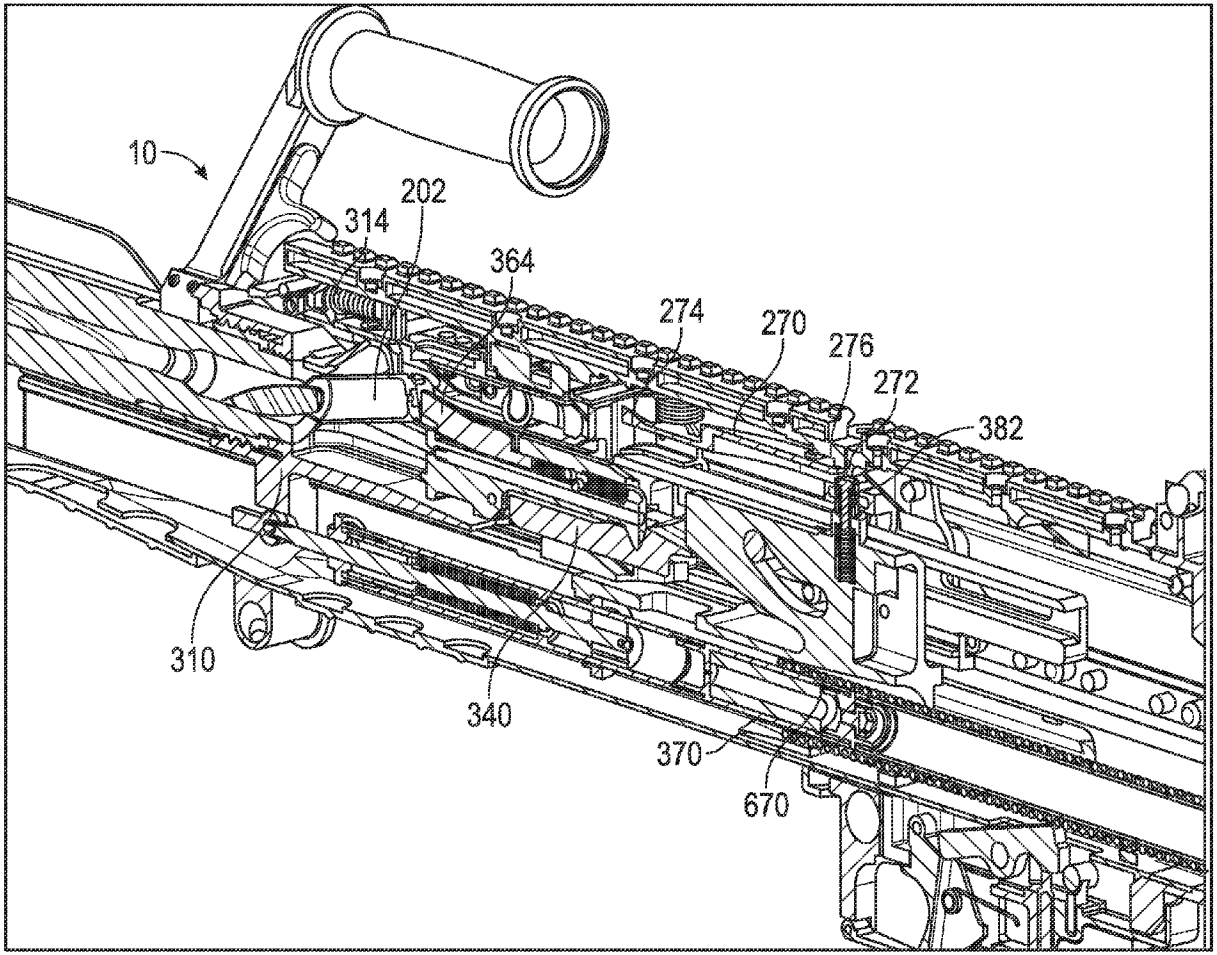

FIG. 19 is a partial cross-sectional view of the weapon system 10 in a second position of the firing cycle according to an exemplary embodiment, subsequent to the position of FIG. 18. The position depicted in FIG. 19 may be considered a chambering condition.

In the position of FIG. 19, the trigger 154 (FIG. 2) has been pulled, releasing the op-rod assembly 370 and the bolt assembly 340 such that the drive spring 670 forces the op-rod assembly 370 and bolt assembly 340 forward. In this exemplary embodiment, the drive spring 670 is sized to provide a forward momentum at the firing position that is approximately one-third to one-half of the subsequent impulse of the fired round. As shown in FIG. 19, as the bolt assembly 340 moves forward, the rammer 364 engages the round 202. FIG. 25 depicts the forward movement of the op-rod assembly 370 and bolt assembly 340 approximately mid-way between points 2550 and 2551.

Figure 20:
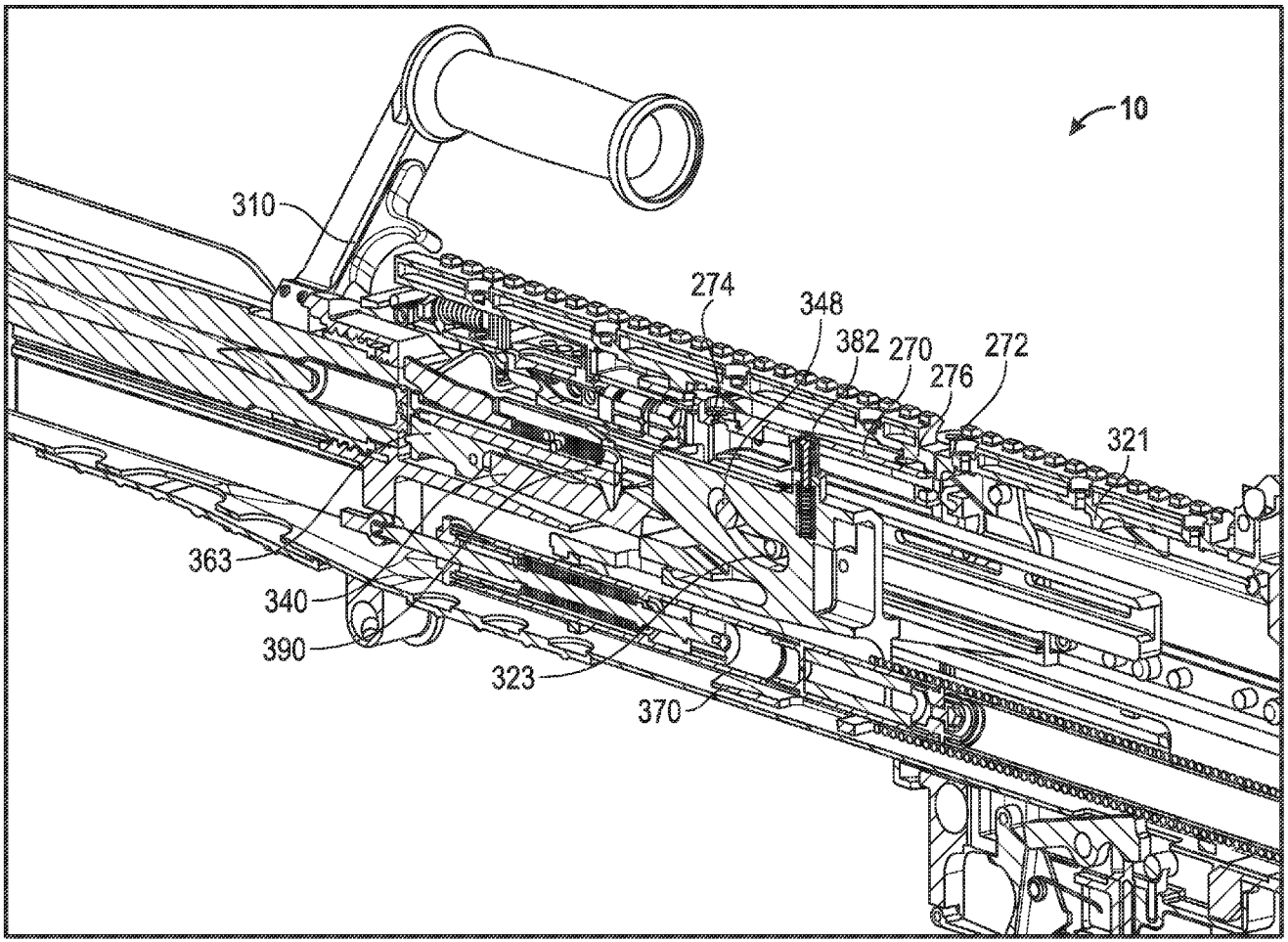

Further shown in FIG. 19, the op-rod assembly 370 and the bolt assembly 340 continue to be driven forward by the drive spring 670 and the rammer 364 contacts the base of the round 202 to guide the round 202 out of the link into the chamber 411 of the barrel 410. As noted above, the round guide 314 of the barrel extension 310 assists in guiding the round 202 downward into the chamber 411 of the barrel 410 while the cartridge stripping guide 285 (FIG. 6) retains the link. FIG. 20 is a partial cross-sectional view of the weapon system 10 in a further position of a firing cycle according to an exemplary embodiment, subsequent to the position of FIG. 19. In this position, the op-rod assembly 370 and the bolt assembly 340 have been driven forward until the round stops against the chamber, the extractor 366 snaps over the round rim and the bolt assembly 340 engages the forward interior face of the barrel extension 310, as depicted in point 2551 of FIG. 25. The bolt assembly 340 transfers its forward momentum to the barrel extension 310.

At this point, the bolt assembly 340 is generally axially unsecured from the op-rod assembly 370 such that the bolt assembly 340 stops and the op-rod assembly 370 continues forward. More specifically, the cam shaft 348 of the bolt assembly 340 has reached the cam relief 323 of the hold-up cam 321 on each side of the barrel extension 310. As such, the hold-up cam 321 no longer maintains the radial position of the cam shaft 348, and thus, the radial position of the lock block 342. However, after disengagement with the hold-up cam 321, the cam shaft 348 of the bolt assembly 340 is still guided by the cam 386 of the op-rod assembly 370. As such, as the cam 386 continues to move forward and the bolt assembly 340 is pressed against the barrel extension 310, the cam shaft 348 is guided down the cam 386 to press the aft end of the lock block 342 downward.

Figure 21:
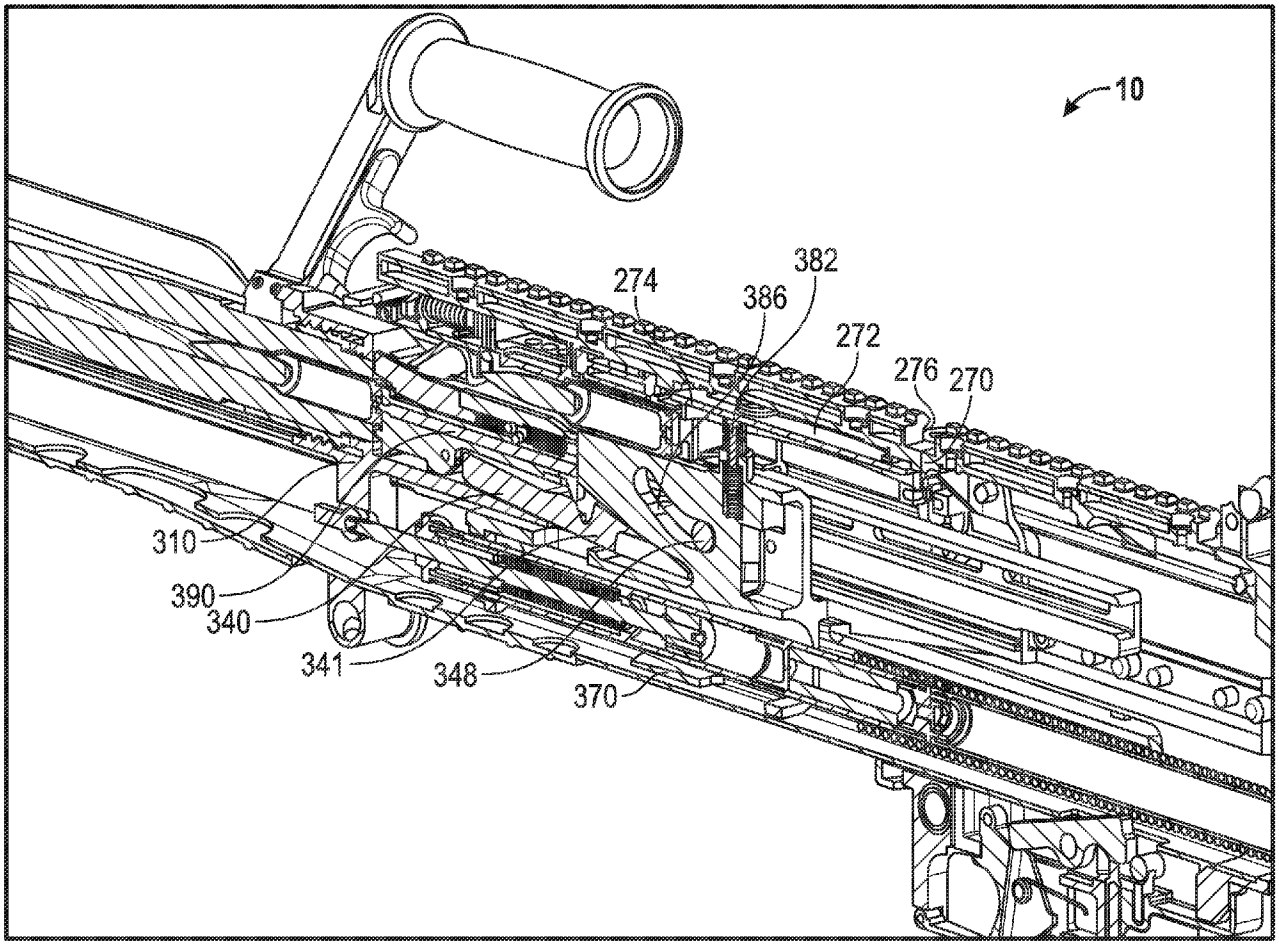

FIG. 21 is a partial cross-sectional view of the weapon system 10 in a further position of the firing cycle according to an exemplary embodiment, subsequent to the position of FIG. 20. Between FIGS. 20 and 21, the lock block 342 is actuated downward, the hold cam 394 is moved away from the cam protrusion 396. In one exemplary embodiment, the hold cam 394 is moved away from the cam protrusion 396 at approximately three-quarters of the lock block 342 movement. At this point, the firing pin 390 is released from the lock block 342, and the forward movement of the op-rod assembly 370 forces the firing pin 390 forward to initiate firing, as also described in greater detail below. The relative movement is timed such that the complete momentum of the op-rod assembly 370 is transferred to the other components of the operating group before the impulse of the round is fully absorbed. At this point, the operating group is coupled to the barrel group to receive the round momentum and be driven rearward, such that this embodiment may reduce gas accelerator requirements.

In the position of FIG. 21, the op-rod assembly 370 and the bolt assembly 340 have been driven forward until the bolt assembly 340 engages the forward interior face of the barrel extension 310 and the forward end of the op-rod assembly 370 engages the aft end of the barrel assembly 340. In this position, the cam shaft 348 of the bolt assembly 340 has reached the termination point of the cam 386 of the op-rod assembly 370 such that the op-rod assembly 370 cannot move forward relative to the bolt assembly 340. In this position, depicted by points 2552 and 2553 in FIG. 25, the firing pin 390 as driven by the op-rod is about to impart at least some of the energy of the op-rod assembly 370 to initiate firing of the round 202. The remaining energy of the op-rod assembly 370 is transferred to the barrel extension 310 via the bolt assembly 340. As additionally shown in FIG. 21, the downward position of the bolt assembly 340 is such that rear face 341 of the bolt assembly 340 engages the barrel extension lock 319 of the barrel extension 310 to momentarily lock or otherwise secure the bolt assembly 340 to the barrel extension 310. During forward movement of the op-rod assembly 370, the forward extension 374 moves the poppet valve 520 forward in chamber 514 (FIGS. 12 and 16).

Figure 22:
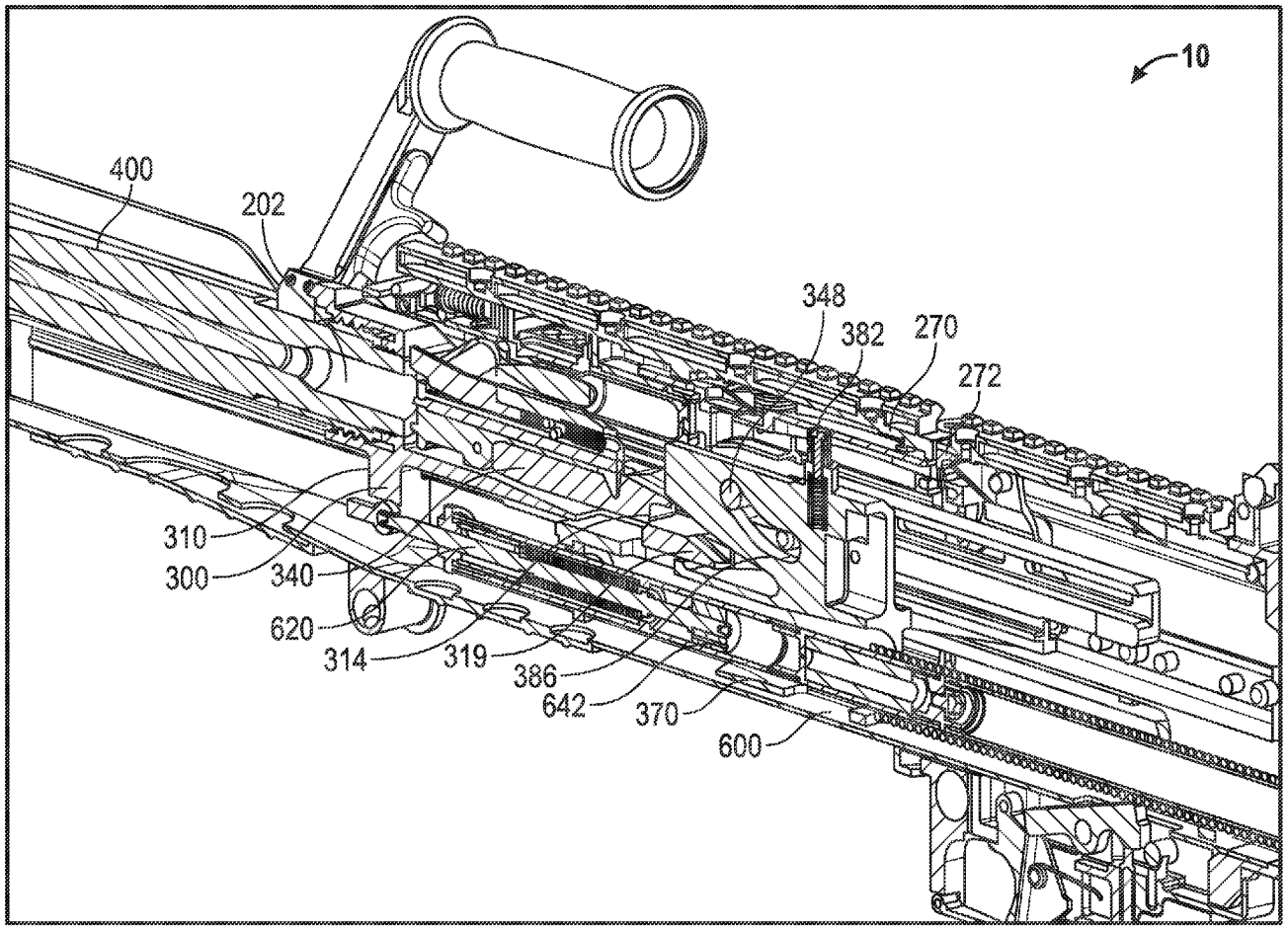

FIG. 22 is a partial cross-sectional view of the weapon system 10 in a further position of the firing cycle according to an exemplary embodiment, subsequent to the position of FIG. 21. The positions depicted in FIGS. 22-24 may be considered a recoil condition.

Figure 23:
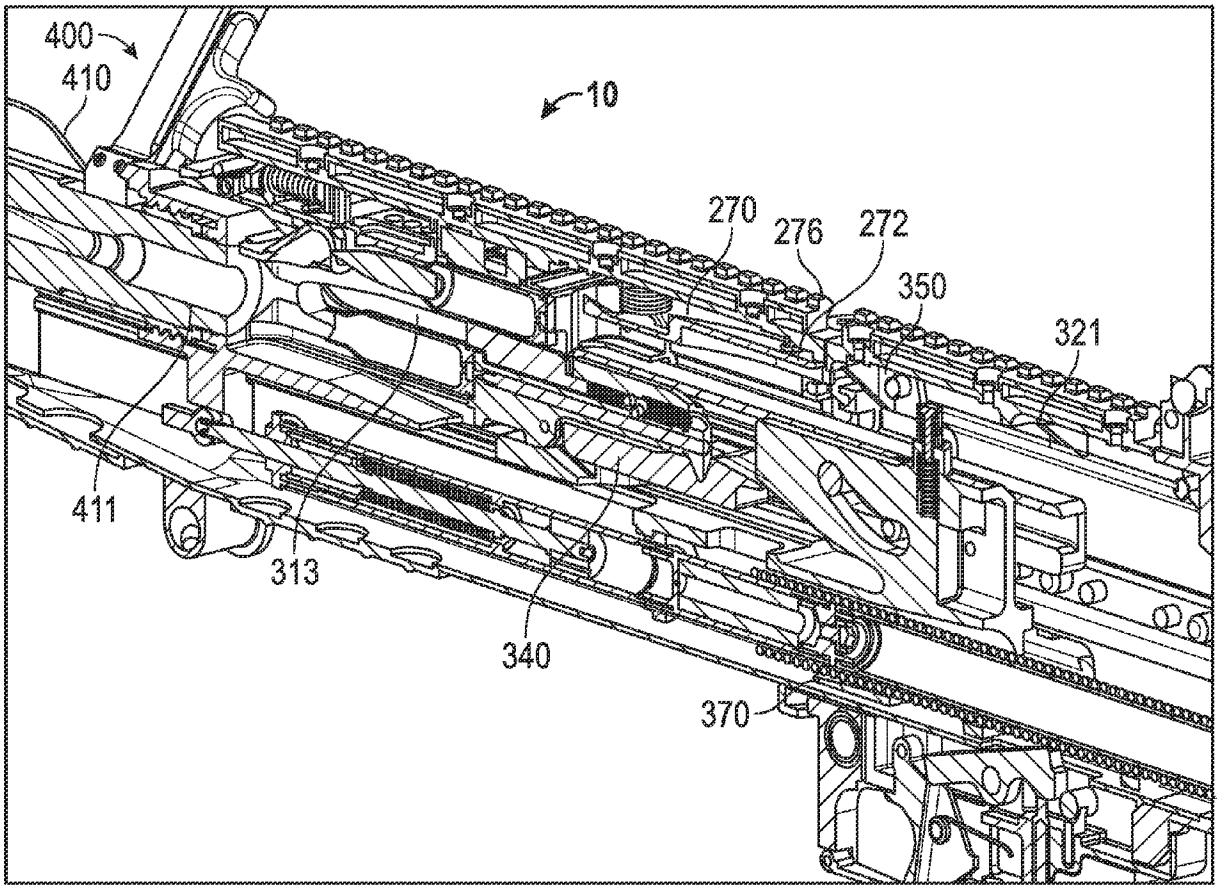
Figure 24:
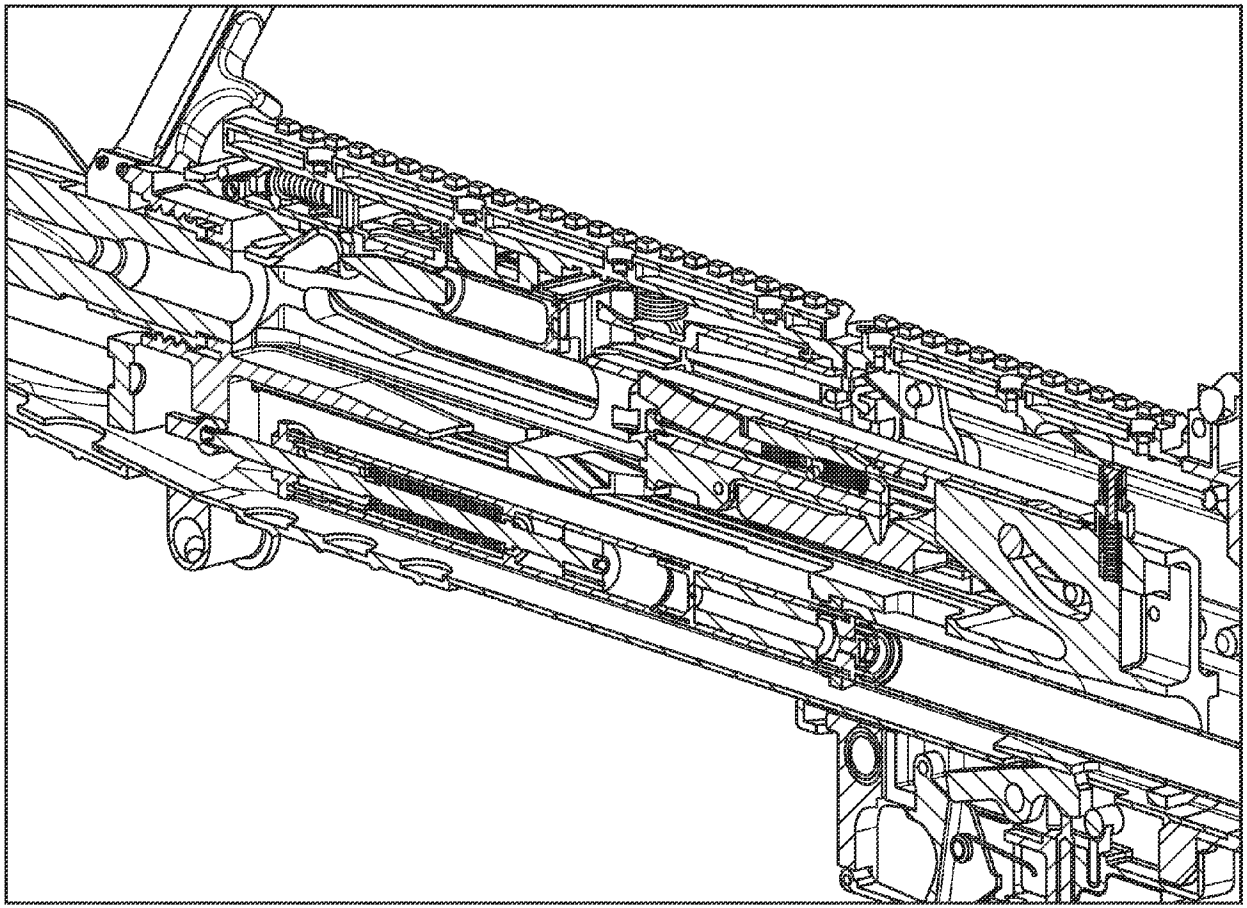

In the position of FIG. 22, the round 202 has been ignited by the firing pin 388 and the resulting forward momentum of the round 202 drives the barrel extension 310, the bolt assembly 340, the op-rod assembly 370, and the barrel assembly 400 reverses velocity, represented by point 2554 in FIG. 25, which is the point that the op-rod assembly 370 begins acceleration rearward and the bolt assembly 340 and barrel assembly 400 are decelerated and begin to unlock from one another. Subsequent to the initial rearward movement, as shown in FIG. 23, the cam shaft 348 travels up the cam 386 of the op-rod assembly 370 to disengage the rear face 341 of the bolt assembly 340 from the barrel extension lock 319 of the barrel extension 310, and thus, releases the bolt assembly 340 from the barrel extension 310, as represented by point 2555 in FIG. 25. In other words, the op-rod assembly 370 and bolt assembly 340 unlock from the barrel extension 310 between points 2554 and 2555, which concludes with the bolt assembly 340 traveling rearward with the op-rod assembly 370. As also shown in FIG. 22, as the op-rod assembly 370 moves rearward, the hold spring 392 returns the firing pin 390 to the initial position, at which the lock block 342 is pivoted upward to reengage the cam protrusion 394.

As noted above, the ignition of the round 202 imparts forward momentum to the bullet and associated propellant gas of the round 202 with an equal change of momentum to the operating group 300 to the rear, which is represented by point 2554 in FIG. 25. The net change in momentum of the operating group 300 is approximately twice the forward momentum of the drive spring 670 to op-rod assembly 370 such that the resulting rearward momentum on the op-rod assembly 370 is approximately equal to the forward momentum imparted by the drive spring 670 (FIG. 17). The buffer assembly 600 absorbs a portion of the rearward momentum through the centering spring 620 and fluid damping of the hydraulic fluid through the piston 642. Similarly, the buffer assembly 600 absorbs the forward energy of the operating group 300 in the event the round 202 does not fire or dry fires.

FIG. 23 is a partial cross-sectional view of the weapon system 10 in a further position of the firing cycle according to an exemplary embodiment, subsequent to the position of FIG. 22. In this position, the bullet of the fired round 202 has traveled past the port 417 in the barrel 410. A portion of the gas from the burnt propellant flows through the port 417 into the chamber 514 of the gas accelerator 500 to force the poppet valve 520 rearward. The forward extension 374 of the op-rod assembly 370 is coupled to the poppet valve 520 such that the op-rod assembly 370 is accelerated rearward, and a corresponding forward momentum is transferred to the barrel assembly 400 to slow rearward momentum, which, as noted above is represented by point 2555 in FIG. 25.

As the bolt assembly 340 travels rearward, the cam shaft ends 350 engage the hold-up cam 321, and the bolt assembly 340 and op-rod assembly 370 move as a unit rearward. During rearward motion of the bolt assembly 340, the claw portion of the extractor 366 (FIG. 11) pulls the case of the fired round rearward, out of the chamber 411 until the case impacts the ejector 316 (FIG. 9) on the barrel extension 310, which rotates the case out through the ejection windows 313, 183 (FIG. 2) in the barrel extension 310 and receiver housing 112, respectively. The extraction action may occur approximately at point 2577. Typically, the windows 183, 313 are slightly larger than an unfired round to facilitate ejection of a dud round. The momentum from the gas accelerator 500 continues to drive the op-rod assembly 370 and bolt assembly 340 until slowed and stopped by the drive spring 670, as represented by point 2558 in FIG. 25 and additionally corresponding to the charged position of FIG. 18 in preparation of repeating the firing cycle. If the op-rod assembly 370 has excessive energy, the op-rod assembly 370 will bottom out on the barrel extension 310 and the buffer assembly 600 will absorb this energy, as shown by the max recoil position of FIG. 24. The firing cycle repeats until the trigger 154 (FIG. 2) is released and the sear re-engages the op-rod assembly 370.

Throughout the cycle, the stroke of the operating group 300, particularly the barrel extension 310, is relatively short. For example, in a weapon system with a length of 150 calibers and a barrel with a length of 70 calibers the stroke of the barrel extension may be, for example, +/−2 calibers with associated an associated op-rod assembly stroke of 19-21 calibers and a bolt assembly stroke of 15-17 Calibers.

Reference is briefly made to FIGS. 5, 6, 12, 13, and 18-24 to describe the operation of the feed assembly 200 during the firing cycle. As the op-rod assembly 370 moves forward (e.g., FIGS. 18-21), the feed roller 382 engages the cam path 272 of the feed index cam 270 of the feeder 250. The cam path 272 is curved, so as the op-rod assembly 370 travels an axial path, the feed roller 382 forces the feed index cam 270 to pivot about pivot 276. As the feed index cam 270 pivots, the pivoting lever 274 engages the drive pawl 280 and feed shuttle 282 (FIG. 6) to index the rounds one position. The action of feeding the round pushes the loose link in the strip position out of the side of the feed assembly 200. During op-rod rearward travel, the feed index cam returns to its beginning position; the hold pawls 223 in the feed tray hold the ammunition belt in position. As such, as the operating group 300 chambers a round and fires the chambered round, the feed assembly 200 positions a subsequent round for chambering and firing during a subsequent firing cycle. Although the depicted embodiments show a feed system in which linked rounds are indexed through the feeder, in other embodiments, the rounds may be individually chambered by an operator or the rounds may be biased into the chamber from a magazine.

Figure 26:
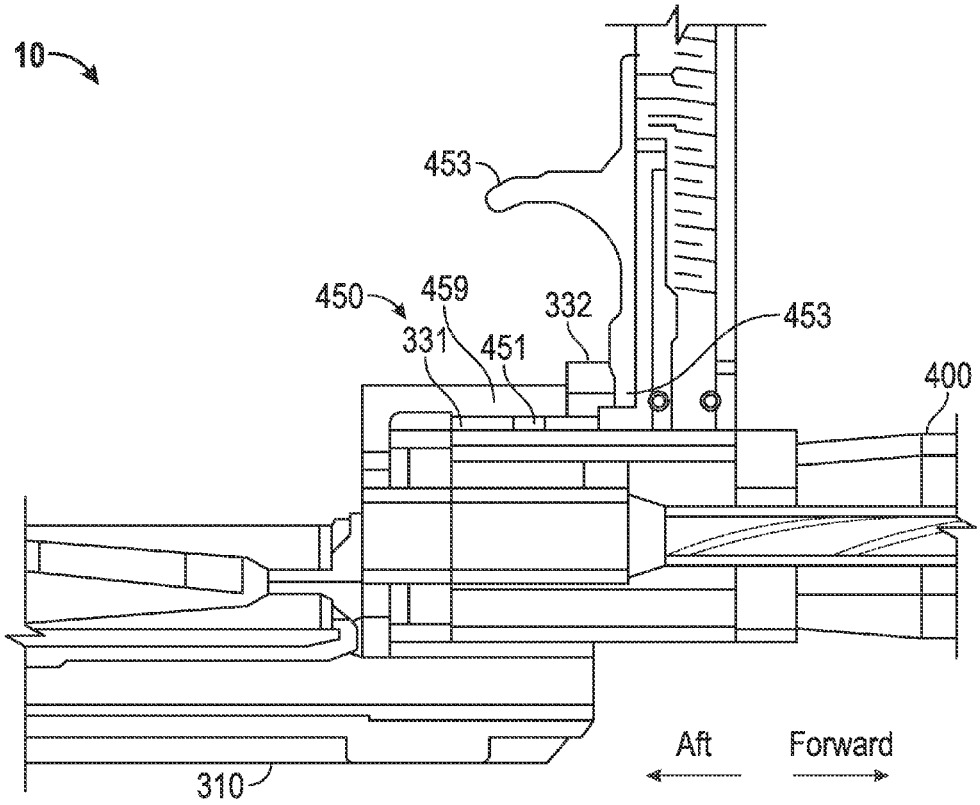
FIG. 26 is a partial cross-sectional view of a barrel release mechanism for the weapons system according to an exemplary embodiment.

FIG. 26 is a partial cross-sectional view of the barrel assembly 400 coupled to the barrel extension 310 and particularly shows the release mechanism 450 for expedient removal of the barrel assembly 400 from the weapon system 10 during disassembly. In the assembled condition, as shown, the helical locking lugs 331 of the barrel extension 310 engage the helical locking lugs 451 of the barrel assembly 400 to prevent relative axial movement between the barrel extension 310 and the barrel assembly 400. In this position, the lock projection 453 extends into the gap of the helix lock surface 332 to prevent rotation of the barrel assembly 400 relative to the barrel extension 310, thus ensuring that the lugs 331, 451 remain engaged. As noted above, the locking lugs 451 are on a rotating sleeve 459, similar to as a nut on the barrel assembly 400 with interrupted threads that engages mating threads of locking lugs 331 on the barrel extension 310. In general, the trigger projection 453 and lock surface 332 may be formed by any angled or cam surfaces that prevent relative movement. The helical locking lugs are designed to rotate until the barrel is positioned aftward against a stop surface in the barrel extension thus insuring a constant headspace for the weapon. The trigger projection and lock surface are structured such that they will always engage under any final locked position of the barrel sleeve. To remove the barrel assembly 400, a user pulls the barrel lock 452 upward (or otherwise radially outward). This retracts the lock projection 453 from the helix lock surface 332, thus enabling relative circumferential movement between the barrel extension 310 and the sleeve 459 of the barrel assembly 400. As the barrel sleeve 459 rotates, the lugs 451 disengage from the lugs 331, e.g., instead of the lugs 331 and 451 being circumferentially aligned, the lugs 331 and 451 are offset such that the lugs 451 are positioned within the gaps between the lugs 331 and vice versa. In this position, the barrel assembly 400 may be pulled in an axial direction and separated from the barrel extension 310.

To reattach, the barrel assembly 400 is slid back onto the barrel extension 310 with the lugs 331 and 451 offset from one another, then the barrel sleeve 459 is rotated to align the lugs 331 and 451 as the spring biases the trigger projection 453 into the lock surface 332, thus locking the barrel assembly 400 onto the barrel extension 310. The lugs 331 and 451 may be canted or otherwise angled relative to one another to facilitate engagement. When the locking lugs 451 rotate to lock the barrel assembly 400, the barrel assembly 400 does not rotate. Instead, the barrel assembly 400 is keyed in rotation to the barrel extension 310 and the accelerator 500 engaging the front of the receiver assembly 100.

A more detailed description of impulse averaging model associated with the firing cycle and the resulting impact on the receiver (and thus, operator) will now be mathematically described with Equations (1)-(20), which use the following assumptions: 1) no friction or non-conservative forces are present; 2) the barrel extension 310, and thus the barrel 410, are free to travel forward or aft relative in the receiver assembly 100 with very little resistance and no appreciable stored energy; 3) collisions are perfectly elastic; and 4) the cartridge impulse resulting from the pressure time curve frequency is several orders of magnitude above the operating frequencies.

Equation (1) describes the basic equation for return velocity of a moving operating group:

$$Ir=M_{bg}*V_r \qquad \text{Equation (1)}$$

wherein

Ir is the rearward momentum;

$M_{bg}$ is the mass of the barrel group; and $V_r$ is the rearward velocity of the barrel group.

Equation (1) may be modified to account for any forward velocity of the operating group, as represented by Equation (2):

$$Ir=M_{bg}*V_r+M_{bg}*V_f \quad \text{Equation (2)}$$

wherein $V_f$ is the forward velocity of the barrel group.

For perfect impulse averaging (e.g., $V_r=V_f$), Equations (1) and (2) can be rewritten as Equation (3):

$$Ir=2M_{bg}*V_f \quad \text{Equation (3)}$$

For an open gas accelerator, Equation (3) may be modified as represented by Equation (4):

$$Ir=2M_{bg}*V_f+Ig \quad \text{Equation (4)}$$

wherein,

Ig is the momentum imparted by the gas accelerator to the barrel group.

Equation (4) can be rewritten as Equation (5) to solve for Vf.

$$V_f=(Ig-Ir)/2M_{bg} \quad \text{Equation (5)}$$

In a perfectly elastic collision between the operating group and barrel group, the momentum relationship may be represented by Equation (6):

$$(M_{bg}+M_{or})V_f=M_{or}*V_n \quad \text{Equation (6)}$$

wherein $M_{or}$ is the mass of the operating rod; and $V_{fl}$ is the velocity of the operating rod before the collision.

Considering the barrel group and operating group act as a single mass after collision ($M_t=M_{bg}+M_{or}$), Equation (6) may be rewritten as Equation (7).

$$V_f=M_{or}*V_{lf}/Mt \quad \text{Equation (7)}$$

wherein

Mt is the total mass.

A combination of Equations (5) and (7) may be expressed as Equation (8).

$$(Ir-Ig)/2M_{bg}=M_{or}*V_{1f}/Mt \quad \text{Equation (8)}$$

Upon solving for Vlf, Equation (8) may be expressed as Equation (9).

$$V_{lf}=Mt(Ir-Ig)/(2*M_{bg}*M_{or}) \quad \text{Equation (9)}$$

Equation (10) describes the kinetic and potential energy balance between the drive spring and op-group.

$$\tfrac{1}{2}M_{or}V_{lf}^2=\tfrac{1}{2}K_{or}*x_{op}^2 \quad \text{Equation (10)}$$

wherein $K_{or}$ is the spring constant of the drive spring; and $x_{op}$ is the distance the operating rod is retracted from a position of rest.

The force equation of drive spring is expressed in Equation (11).

$$F=K_{or}*x_{op}. \quad \text{Equation (11)}$$

Equations (10) and (11) may be combined as Equation (12).

$$V_{lf}^2=F^2/(K_{or}*M_{or}). \quad \text{Equation (12)}$$

Equations (9) and (12) may be combined as Equation (13).

$$[M_t(Ir-Ig)/(2*M_{bg}*M_{or})]^2=F^2/(K_{or}*M_{or}) \quad \text{Equation (13)}$$

Solving for force, Equation (13) may be expressed as Equation (14).

$$F=\tfrac{1}{2}*(K_{or}/M_{or})*\{1+M_{or}/M_{bg}\}*\{Ir-Ig\} \quad \text{Equation (14)}$$

Equation (14) may be expressed as Equation (15).

$$F=\tfrac{1}{2}*\omega_{nor}(1+M_{or}/M_{bg}*(Ir-Ig) \quad \text{Equation (15)}$$

wherein $\omega_{nor}$ is the natural frequency of the op-rod and spring; and $\omega_{nor=sqrt(Kor/Mor)}$ The gas accelerator should supply enough energy to return the op-rod to a charged position, as represented by Equation (16).

$$Ig=M_{or}*V_{lf} \quad \text{Equation (16)}$$

The energy balance between the drive spring and op-rod assembly corresponds to a kinetic energy balance with spring potential energy and may be represented by Equation (17).

$$V_{lf}^2=x(k_{or}/m_{or})^{1/2} \quad \text{Equation (17)}$$

Combining Equations (16) and (17) results in Equation (18).

$$Ig=X_{op}*M_{or}*\omega n_{or} \quad \text{Equation (18)}$$

Combining Equations (15) and (18) results in Equation (19), which represents an exemplary maximum force imparted to the receiver in the exemplary embodiments discussed herein.

$$F=\tfrac{1}{2}*\omega_{nor}(1+M_{or}/M_{bg})*[Ir-X_{op}*M_{or}*\omega_{nor}] \quad \text{Equation (19).}$$

In a conventional weapon system in which the barrel group is fixed to the receiver and a gas acceleration system, the max force is represented by Equation (20).

$$F=\omega_{ngun}(Ir-Ig) \quad \text{Equation (20)}$$

In other words, using similar reasoning for the gas impulse requirements of Equation 18, the total force may be represented by Equation (21):

$$F=\omega_{ngun}[Ir-X_{op}*M_{or}*\omega_{nor}] \quad \text{Equation (21)}$$

The force of a short recoil impulse averaging weapon, such as that described above may be compared to the force of a conventional gas operated system as represented by Equation (22):

$$F_{SRIA}/F_{Conv}=\tfrac{1}{2}*\omega_{nor}(1+M_{or}/M_{bg})*[Ir-X_{op}*M_{or}*\omega_{nor}]/\omega_{ngun}[Ir-X_{op}*M_{or}*\omega_{nor}] \quad \text{Equation (22)}$$

Equation (22) may be rearranged with assumptions of equal component weights and internal spring rates, as represented below in Equation (23):

$$F_{SRIA}/F_{Conv}=\tfrac{1}{2}*\omega_{nor}(1+M_{or}/M_{bg})/\omega_{ngun} \quad \text{Equation (23)}$$

As a result, under this evaluation, one variable may be the weapon mount spring to ground which drives the weapon natural frequency for the conventional gun. The weapon mount spring to ground can vary from 160 lb/in (manned) to 6000 lb/in (hard mounted), as examples.

Figure 27:
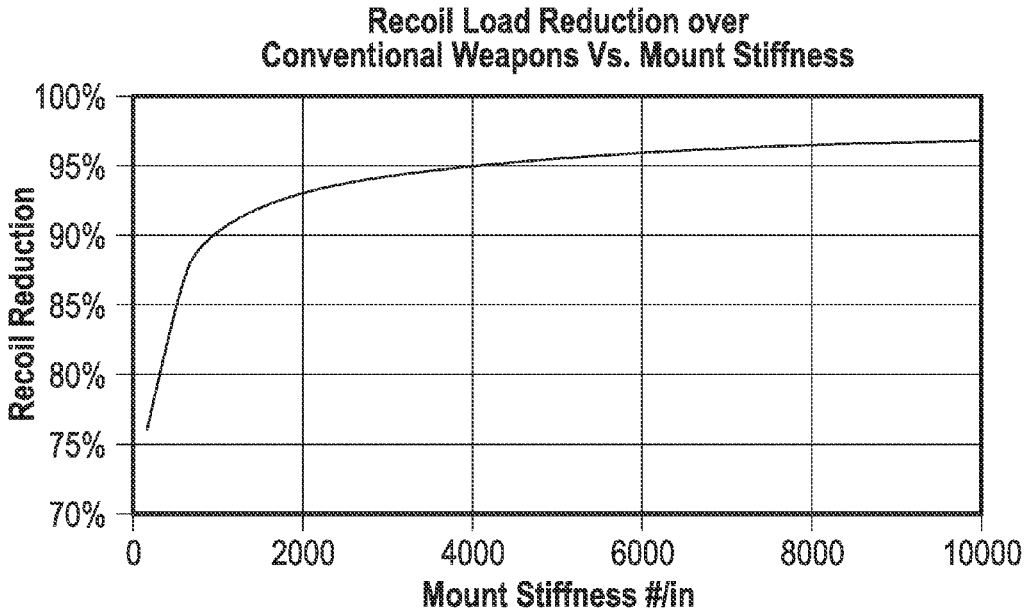
FIG. 27 is a graph depicting examples of recoil reduction as a function of mount stiffness for exemplary weapon system relative to conventional weapon systems.

FIG. 27 is a graph depicting examples of recoil reduction as a function of mount stiffness for exemplary weapon system relative to conventional weapon systems. As shown in FIG. 27, the exemplary embodiments such as discussed herein may reduce the recoil by 75% over conventional weapons for man firing and by 95% for hard mounting.

Accordingly, the weapon system 10 discussed above may provide a number of advantages relative to conventional weapons, including a lower recoil force for high impulse rounds, more weapon control at a lighter weight, a reduction in sensitivity to recoil mass, higher firing rates, and a safer and simpler weapon.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A weapon system for firing a round, comprising:

a receiver;

an operating group configured to operate the weapon system through a charged condition, a firing condition, and a recoil condition, the operating group comprising a barrel extension at least partially housed within the receiver and arranged to axially translate relative to the receiver;

an operating rod (op-rod) assembly at least partially housed and arranged to axially translate within the barrel extension in the charge condition, the firing condition, and the recoil condition; and a bolt assembly coupled to the op-rod assembly and at least partially housed and arranged to axially translate within the barrel extension;

a barrel coupled to the barrel extension and defining a chamber;

a gas accelerator with a first end coupled to the barrel and a second end coupled to the op-rod assembly; and a buffer assembly comprising a drive spring having a first end coupled to the receiver and a second end coupled to the op-rod assembly, wherein, in the charged condition, the op-rod assembly and the bolt assembly are retracted against the drive spring;

wherein, in the firing condition, the op-rod assembly and bolt assembly are driven by the drive spring such that the round is guided into the chamber and the op-rod assembly and bolt assembly are locked to the barrel extension and a forward momentum of the op-rod assembly is imparted to the operating group and the round is fired, wherein a portion of an impulse of the fired round stops the forward momentum of the operating group; and wherein, in the recoil condition, the operating group is driven rearward by the remaining portion of the impulse of the fired round, the gas accelerator imparts additional rearward momentum to the op-rod assembly and bolt assembly and stops rearward momentum of the barrel and barrel extension, and the op-rod assembly and the bolt assembly are stopped by the drive spring.

2. The weapon system of claim 1, wherein the buffer further includes a hydraulic piston configured to resist forward and rearward movement of the barrel extension.

3. The weapon system of claim 2, wherein the buffer further includes a buffer spring configured to resist forward and rearward movement of the barrel extension.

4. The weapon system of claim 3, wherein the hydraulic piston and the buffer spring are configured such that any force transfer between the barrel extension and the receiver occurs through the hydraulic piston and the buffer spring.

5. The weapon system of claim 1, further comprising a lock assembly configured to secure the bolt assembly to the op-rod assembly in the charged condition through chambering the round.

6. The weapon system of claim 5, wherein the lock assembly is configured to release the bolt assembly from the op-rod assembly in the firing condition.

7. The weapon system of claim 6, wherein the lock assembly is further configured to secure the bolt assembly to the barrel extension in the firing condition.

8. The weapon system of claim 7, wherein the lock assembly includes a lock pin, a first cam defined in the op-rod assembly, and a second cam in the barrel extension, wherein the lock pin engages the first cam and the second cam to secure and release the bolt assembly relative to the barrel extension and the op-rod group.

9. The weapon system of claim 8, wherein in a first portion of the firing condition, the lock pin is engaged by the first cam and the second cam to secure the bolt assembly to the op-rod assembly such that the op-rod assembly forces the bolt assembly forward, and wherein, in a second portion of the firing condition upon contact of the bolt assembly and the barrel extension, the lock pin disengages from the second cam and the first cam guides the lock pin such that the bolt assembly forms a locking engagement with the barrel extension.

10. The weapon system of claim 9, wherein, in the recoil condition, the rearward movement of the op-rod assembly guides the lock pin within the second cam such that the bolt assembly is released relative to the barrel extension.

11. The weapon system of claim 1, wherein in an ejection condition, a case of the round is coupled to the bolt assembly.

12. The weapon system of claim 11, wherein the barrel extension includes an extractor such that, in the ejection condition, the extractor engages the case during the rearward movement of the bolt assembly to remove round from chamber and eject the case from the weapon system.

13. A method for firing a weapon, comprising:

retracting a bolt assembly and an operating rod (op-rod) assembly relative to a barrel extension against a drive spring;

driving the bolt assembly and the op-rod assembly with a forward momentum within the barrel extension such that the bolt assembly chambers a round and contacts the barrel extension, imparting forward momentum to the op-rod assembly, the bolt assembly and the barrel extension such that the round is fired, whereby the firing of the round stops the forward momentum and imparts an impulse of rearward momentum on the op-rod assembly, the bolt assembly, and the barrel extension, wherein the driving step includes securing the bolt assembly to the op-rod assembly in the charged condition until the bolt assembly engages the barrel extension, wherein the driving step includes releasing the bolt assembly from the op-rod assembly when the bolt assembly engages the barrel extension, wherein the driving step includes securing the bolt assembly to the barrel extension during the contact with the barrel extension;

guiding gases from the round with a gas accelerator to drive the op-rod assembly rearward and to stop the rearward momentum of the barrel extension; and absorbing the rearward momentum of the op-rod assembly with the drive spring.

14. The method of claim 13, wherein the driving step includes driving the bolt assembly and the op-rod assembly with the forward momentum that is approximately one-third to one-half of the impulse of the round.

15. The method of claim 13, further comprising the step of restraining movement of the op-rod assembly in forward and aft directions with a buffer assembly.

16. The method of claim 15, wherein the restraining step includes restraining movement of the barrel extension assembly in forward and aft directions with a soft spring and a hydraulic piston valve of the buffer assembly.

17. The method of claim 13, wherein the step of securing the bolt assembly to the barrel extension includes guiding a cam on the bolt assembly into a cam relief of a hold-up cam on the barrel extension and down an op-rod cam on the op-rod assembly such that a first lock surface of bolt assembly pivots to engage a second lock surface of the bolt assembly.

* * * * *